US005752333A

United States Patent [19]

Nakagawa et al.

[11] Patent Number: 5,752,333

[45] Date of Patent: May 19, 1998

[54] AREA LIMITING EXCAVATION CONTROL SYSTEM FOR CONSTRUCTION MACHINES

[75] Inventors: Takashi Nakagawa, Ibaraki-ken; Hiroshi Watanabe, Ushiku; Masakazu Haga; Kazuo Fujishima, both of Ibaraki-ken; Eiji Egawa, Tsuchiura, all of Japan

[73] Assignee: Hitachi Construction Machinery Co., Ltd., Tokyo, Japan

[21] Appl. No.: 817,349

[22] PCT Filed: Aug. 8, 1996

[86] PCT No.: PCT/JP96/02252

§ 371 Date: Apr. 9, 1997

§ 102(e) Date: Apr. 9, 1997

[87] PCT Pub. No.: WO97/07297

PCT Pub. Date: Feb. 27, 1997

[30] Foreign Application Priority Data

Aug. 11, 1995 [JP] Japan ..... 7-205697

[51] Int. Cl.[6] ..... F02F 3/43

[52] U.S. Cl. ..... 37/348; 172/2; 364/424.07

[58] Field of Search ..... 37/348; 172/2, 172/3, 4, 4.5, 7, 9, 11; 364/424.07; 342/357

[56] References Cited

U.S. PATENT DOCUMENTS

| | | | |
|---|---|---|---|
| 5,438,771 | 8/1995 | Sahm et al. | 37/348 |
| 5,446,981 | 9/1995 | Kamada et al. | 37/348 |
| 5,497,568 | 3/1996 | Strickland | 37/348 |
| 5,528,843 | 6/1996 | Rouke | 37/348 |
| 5,598,648 | 2/1997 | Moriya et al. | 37/348 |

FOREIGN PATENT DOCUMENTS

| | | |
|---|---|---|
| 63-219731 | 9/1988 | Japan . |
| 4-136324 | 5/1992 | Japan . |

*Primary Examiner*—Michael J. Carone
*Assistant Examiner*—Robert Pezzuto
*Attorney, Agent, or Firm*—Fay, Sharpe, Beall, Fagan, Minnich & McKee

[57] ABSTRACT

An area where a front device 1A is movable is set in advance. A target speed vector of the front device is modified such that its component in the direction toward a boundary of the set area is reduced, by using signals obtained by reducing operation signals input from control lever units 4a–4c when a mode switch 20 is turned on and the front device is within and near the boundary of the set area, and by using the operation signals as they are when the mode switch 20 is turned off. When the front device is outside the set area, the target speed vector is modified so that the front device is returned to the set area. Thus, excavation within a limited area can be performed efficiently and smoothly, and an operator can select one of an accuracy precedence work mode and a speed precedence work mode at his own discretion.

10 Claims, 26 Drawing Sheets

AREA LIMITING EXCAVATION CONTROL SYSTEM FOR CONSTRUCTION MACHINES

TECHNICAL FIELD

The present invention relates to an area limiting excavation control system for construction machines, and more particularly to an area limiting excavation control system which is equipped in a construction machine such as a hydraulic excavator having a multi-articulated front device and can perform excavation while limiting an area where the front device is movable.

BACKGROUND ART

There is known a hydraulic excavator as typical one of construction machines. A hydraulic excavator is made up of a front device comprising a boom, an arm and a bucket which are each pivotable in the vertical direction, and a body comprising an upper structure and an undercarriage. The boom of the front device is supported at its base end to a front portion of the upper structure. In such a hydraulic excavator, front members including a boom are operated by respective manual control levers. However, because the front members are coupled to each other through articulations for pivoting motion, it is very difficult to carry out excavation work over a predetermined area. In view of the above, JP-A-4-136324 proposes an area limiting excavation control system for facilitating such excavation work. The proposed area limiting excavation control system comprises means for detecting a posture of a front device, means for calculating a position of the front device based on a signal from the detecting means, means for teaching an entrance forbidden area where the front device is inhibited from entering, lever gain calculating means for determining a distance d between the position of the front device and a boundary of the taught entrance forbidden area, and then outputting the product of a lever operation signal multiplied by a function depending on the distance d that takes a value 1 when the distance d is greater than a certain value, and a value between 0 and 1 when it is smaller than the certain value, and actuator control means for controlling motion of an actuator in accordance with a signal from the lever gain calculating means. With the construction of the proposed system, since the lever operation signal is restricted depending on the distance to the boundary of the entrance forbidden area, even when the operator attempts to move a tip of the bucket into the entrance forbidden area by mistake, the bucket tip is smoothly stopped at the boundary automatically, or on the way of movement of the bucket tip toward the boundary, the operator can notice approaching to the entrance forbidden area, judging from a reduction in the speed of the front device, and return the bucket tip.

DISCLOSURE OF THE INVENTION

However, the foregoing related art has problems as follows.

With the related art disclosed in JP-A-4-136324, since the lever gain calculating means outputs, to the actuator control means, the product of the lever operation signal directly multiplied by the function depending on the distance d, the bucket tip is gradually slowed down as it approaches the boundary of the entrance forbidden area, and is stopped at the boundary of the entrance forbidden area. Therefore, a shock that would otherwise be generated when the operator attempts to move the bucket tip into the entrance forbidden area can be avoided. But, this related art is designed to reduce the speed of the bucket tip such that the speed is always reduced regardless of the direction in which the bucket tip is moving. Accordingly, when excavation is performed along the boundary of the entrance forbidden area, the digging speed in the direction along the boundary of the entrance forbidden area is also reduced as the bucket tip approaches the entrance forbidden area with operation of the arm. This requires the operator to manipulate a boom lever to move the bucket tip away from the entrance forbidden area each time the digging speed is reduced, in order to prevent a drop of the digging speed. As a result, the working efficiency is extremely deteriorated when excavation is performed along the entrance forbidden area. On the other hand, to increase the working efficiency, the excavation must be performed at a distance away from the entrance forbidden area, thus making it impossible to excavate the predetermined area.

A first object of the present invention is to provide an area limiting excavation control system for construction machines with which excavation within a limited area can be performed efficiently and smoothly.

A second object of the present invention is to provide an area limiting excavation control system for construction machines with which excavation within a limited area can be precisely performed even when operating means is abruptly manipulated.

A third object of the present invention is to provide an area limiting excavation control system for construction machines with which the operator can select one of an accuracy precedence work mode and a speed precedence work mode at his own discretion when performing excavation within a limited area.

(1) To achieve the above first and second objects, according to the present invention, in an area limiting excavation control system for construction machines comprising a plurality of driven members including a plurality of front members which make up a multi-articulated front device and are pivotable in the vertical direction, a plurality of hydraulic actuators for driving respectively the plurality of driven members, a plurality of operating means for instructing operation of the plurality of driven members, and a plurality of hydraulic control valves driven in accordance with operation signals from the plurality of operating means for controlling flow rates of a hydraulic fluid supplied to the plurality of hydraulic actuators, the control system further comprises area setting means for setting an area where the front device is movable; first detecting means for detecting status variables in relation to a position and posture of the front device; first calculating means for calculating the position and posture of the front device based on signals from the first detecting means; first signal modifying means for modifying based on values calculated by the first calculating means, at least the operation signal from the operating means associated with a first particular front member among the plurality of operating means so as to reduce the operation signal, when the front device is near the boundary of the set area therewithin; and second signal modifying means for calculating, based on at least the operation signal reduced by the first signal modifying means and the values calculated by the first calculating means, a speed for control of the front device, and modifying, based on said speed for control, at least the operation signal from the operating means associated with a second particular front member among the plurality of operating means, such that a moving speed of the front device in the direction toward the boundary of the set area is reduced within the set area.

In the present invention constructed as set forth above, the second signal modifying means modifies the operation signal from the operating means associated with the second particular front member such that the moving speed of the front device in the direction toward the boundary of the set area is reduced within the set area. Similarly to the basic invention filed as the international application PCT/JP95/00843 with the convention priority based on JP-A-6-92367 and JP-A-6-92368, therefore, direction change control is carried out so as to slow down movement of the front device in the direction toward the boundary of the set area, enabling the front device to be moved along the boundary of the set area. As a result, excavation within a limited area can be performed efficiently and smoothly.

Because of the direction change control being carried out as speed control in the above-cited basic invention, if the operation signal for the front device is extremely large, or if the operating means is abruptly manipulated, the front device may go out of the set area due to a response delay in the control process, e.g., a delay in the hydraulic circuit, inertial force upon the front device, and so on.

In the present invention, the calculation of the direction change control is performed based on the operation signal from the operating means which has been modified to be reduced by the first signal modifying means. Therefore, even if the operation signal for the front device is extremely large, the movement of the front device is reduced, and even if the operating means is abruptly manipulated, the front device is allowed to start moving slowly. Thus, in any case, the effect of a response delay in the control process is abated and the effect of inertia of the front device is also suppressed. It is thus possible to reduce an amount by which the front device projects out of the set area and to precisely move the front device along the boundary of the set area.

(2) To achieve the above third object, according to the present invention, the control system in the above (1) further comprises mode selecting means for selecting whether or not the operation signal from the operating means is modified to be reduced by the first signal modifying means, and when the mode selecting means is operated to select no modification by the first signal modifying means, the first signal modifying means does not modify the operation signal and the second signal modifying means calculates, based on at least the operation signal not modified and the values calculated by the first calculating means, the speed for control of the front device, and modifies, based on the speed for control, at least the operation signal of the operating means associated with the second particular front member among the plurality of operating means, such that the moving speed in the direction toward the boundary of the set area is reduced.

With this feature, the modification of the operation signal by the first signal modifying means is effected depending on selection made by the mode selecting means and the direction change control is carried out depending on a selected result.

When the direction change control is carried out by using the operation signal which has been modified by the first signal modifying means, the working efficiency may drop because the quick movement of the front device is suppressed even when the operator wants to move the front device fast. In the present invention, when the mode selecting means selects the modification of the operation signal by the first signal modifying means, the front device can be moved with a small amount of projection beyond the set area, as mentioned above, whereas when the mode selecting means does not select the modification of the operation signal by the first signal modifying means, the direction change control is carried out by using the operation signal from the operating means as it is. Accordingly, the front device can be moved depending on the magnitude of the operation signal without dropping the working efficiency.

Thus, with the present invention, when controlling excavation work within a limited area, the operator can perform the work in an optimum mode selected from an accuracy precedence work mode in which an amount of projection of the front device going out of the set area is small, and a speed precedence work mode in which the front device can be moved fast, at his own discretion.

(3) In the above (1) or (2), preferably, the first signal modifying means includes means for modifying the operation signal from the operating means associated with the first particular front member so as to reduce the operation signal such that the operation signal is reduced in a larger amount as a distance between the front device and the boundary of the set area decreases.

By so modifying the operation signal, even when the front device is moved at an extremely high speed, the moving speed of the front device is reduced as the front device approaches the boundary of the set area. Therefore, the effect of a response delay in the control process is abated and the effect of inertia of the front device is also suppressed, enabling the front device to be moved smoothly along the boundary of the set area. In addition, since the moving speed of the front device is reduced as the front device approaches the boundary of the set area, the front device can be operated smoothly with no sudden change in feeling of the operation when it comes close to the boundary of the set area.

(4) In the above (3), preferably, the first signal modifying means further includes means for modifying the operation signal input from the operating means associated with the first particular front member such that the operation signal is reduced in a larger amount as an angle formed between the first particular front member and the boundary of the set area decreases.

By so modifying the operation signal, since the moving speed of the front device is slowed down as the front device is extended to a farther position, the front device can be moved more smoothly along the boundary of the set area in its further extended condition where the front device is more likely to go out of the set area.

(5) In the above (1) or (2), preferably, the first signal modifying means further includes means for modifying the operation signal from the operating means associated with the first particular front member so as to reduce the operation signal by performing a low-pass filter process on the operation signal.

By so modifying the operation signal to be reduced through the los-pass filter process, the operation signal is reduced in its rising period when the operating means is abruptly manipulated. As with the foregoing feature, therefore, even if the operating means is abruptly manipulated, the front device is allowed to start moving slowly, resulting in that the effect of a response delay in the control process is abated and the effect of inertia of the front device is also suppressed.

(6) In the above (1) or (2), in which at least the operating means associated with the first and second particular front members among the plurality of operating means are of the hydraulic pilot type which outputs pilot pressures as the operation signals, and an operating system including the operating means of the hydraulic pilot type drives the corresponding hydraulic control valves, the control system further includes second detecting means for detecting an input amount of the operating means associated with the first particular front member, and the first signal modifying means includes second calculating means inputting a signal from the second detecting means and the values calculated by the first calculating means for calculating a pilot pressure limit value based on the signal from the second detecting means when the front device is near the boundary of the set area therewithin, and first pilot pressure control means for controlling the pilot pressure delivered from the corresponding operating means such that a pilot pressure applied to the hydraulic control valve is not more than the limit value.

With this feature, in the case of the operating system including the operating means of hydraulic pilot type, the first signal modifying means can also modify and reduce the operation signal (pilot pressure) from the operating means associated with the first particular front member when the front device is near the boundary of the set area therewithin.

(7) In the above (6), preferably, the operating system includes first pilot lines for introducing the pilot pressures to the hydraulic control valve associated with the first particular front member, and the first pilot pressure control means includes means for outputting an electric signal corresponding to the pilot pressure limit value, and first electro-hydraulic converting means disposed in the first pilot lines and driven by the electric signal.

(8) In the above (6), preferably, the control system further comprises third detecting means for detecting the pilot pressure controlled by the first pilot pressure control means, and the second signal modifying means includes third calculating means for calculating, based on a signal from the third detecting means, a pilot pressure applied to the hydraulic control valve associated with the second particular front member, and second pilot pressure control means for controlling the pilot pressure delivered from the corresponding operating means such that the pilot pressure calculated by the third calculating means is produced.

(9) In the above (8), preferably, the operating system includes second pilot lines for introducing the pilot pressures to the hydraulic control valve associated with the second particular front member, and the second pilot pressure control means includes means for outputting an electric signal corresponding to the pilot pressures calculated by the third calculating means, second electrohydraulic converting means driven by the electric signal for delivering the pilot pressure, and means disposed in the second pilot line for selecting higher one of the pilot pressure delivered from the operating means associated with the second particular front member and the pilot pressure delivered from the second electro-hydraulic converting means.

(10) In the above (1) or (2), preferably, the first particular front member includes at least an arm of a hydraulic excavator, and the second particular front member includes at least a boom of the hydraulic excavator.

BEST MODE FOR CARRYING OUT THE INVENTION

Hereinafter, embodiments of the present invention applied to a hydraulic excavator will be described with reference to the drawings.

A first embodiment of the present invention will be first explained with reference to FIGS. 1 to 10.

Figure 1:
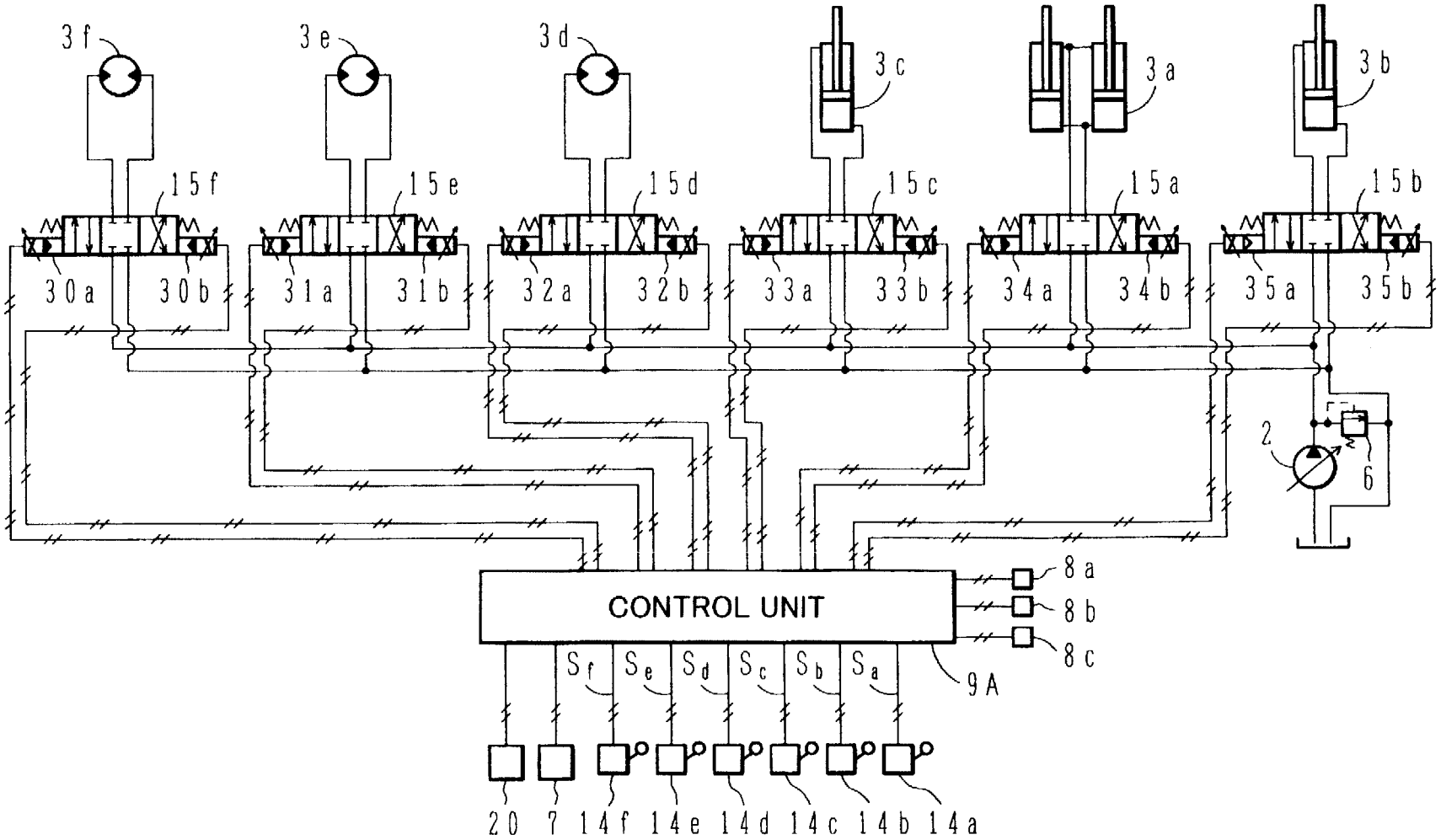
FIG. 1 is a diagram showing an area limiting excavation control system for construction machines according to a first embodiment of the present invention, along with a hydraulic drive system thereof.

In FIG. 1, a hydraulic excavator to which the present invention is applied comprises a hydraulic pump 2, a plurality of hydraulic actuators driven by a hydraulic fluid from the hydraulic pump 2, including a boom cylinder 3*a*, an arm cylinder 3*b*, a bucket cylinder 3*c*, a swing motor 3*d* and left and right track motors 3*e*, 3*f*, a plurality of control lever units 14*a*–14*f* provided respectively corresponding to the hydraulic actuators 3*a*–3*f*, a plurality of flow control valves 15*a*–15*f* connected between the hydraulic pump 2 and the plurality of hydraulic actuators 3*a*–3*f* controlled in accordance with respective operation signals Sa14 Sf from the control lever units 14*a*–14*f* for controlling respective flow rates of the hydraulic fluid supplied to the hydraulic actuators 3*a*–3*f*, and a relief valve 6 which is opened when the pressure between the hydraulic pump 2 and the flow control valves 15*a*–15*f* exceeds a preset value. The above components cooperatively make up a hydraulic drive system for driving driven members of the hydraulic excavator. In this embodiment, the control lever units 14*a*–14*f* are of electric lever type outputting electric signals as the operation signal Sa–Sf. The flow control valves 15*a* to 15*f* have at opposite ends electro-hydraulic converting means, e.g., solenoid driving sectors 30*a*, 30*b*–35*a*, 35*b* including proportional solenoid valves, and the electric signals Sa–Sf depending on the input amounts and directions by and in which the control lever units 14*a* to 14*f* are manipulated by the operator are supplied to the solenoid driving sectors 30*a*, 30*b*–35*a*, 35*b* of the flow control valves 15*a*–15*f*.

Figure 2:
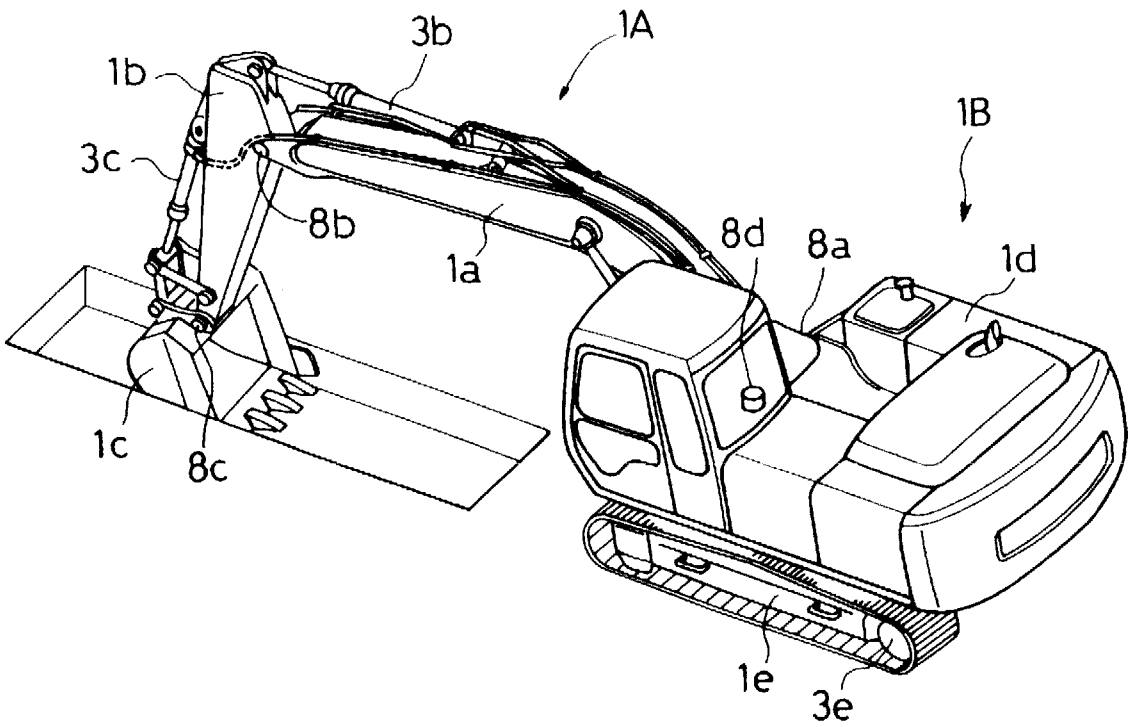
FIG. 2 is a view showing an appearance of a hydraulic excavator to which the present invention is applied, and a shape of a set area around the excavator.

As shown in FIG. 2, the hydraulic excavator is made up of a multi-articulated front device 1A comprising a boom 1*a*, an arm 1*b* and a bucket 1*c* which are each pivotable in the vertical direction, and a body 1B comprising an upper structure 1*d* and an undercarriage 1*e*. The boom 1*a* of the front device 1A is supported at its base end to a front portion of the upper structure 1*d*. The boom 1*a*, the arm 1*b*, the bucket 1*c*, the upper structure 1*d* and the undercarriage 1*e* serve as driven members which are driven respectively by the boom cylinder 3*a*, the arm cylinder 3*b*, the bucket cylinder 3*c*, the swing motor 3*d* and the left and right track motors 3*e*, 3*f*. These driven members are operated in accordance with instructions from the control lever units 14*a*–14*f*.

An area limiting excavation control system according to this embodiment is equipped in the hydraulic excavator constructed as explained above. The control system comprises a setting device 7 for providing an instruction to set an excavation area where a predetermined part of the front device, e.g., a tip of the bucket 1*c*, is movable, depending on the scheduled work beforehand, a mode switch 20 for selecting a speed precedence work mode or an accuracy precedence work mode, angle sensors 8*a*, 8*b*, 8*c* disposed respectively at pivot points of the boom 1*a*, the arm 1*b* and the bucket 1*c* for detecting respective rotational angles thereof as status variables in relation to the position and posture of the front device 1A, and a control unit 9A for receiving the operation signals Sa–Sf from the control lever units 14*a*–14*f*, a setup signal from the setting device 7, a selection signal from the mode switch 20 and detection signals from the angle sensors 8*a*, 8*b*, 8*c*, setting an excavation area where the tip of the bucket 1*c* is movable, and modifying operation signals Sa–Sf.

The setting device 7 comprises manipulation means, such as a switch, disposed on a control panel or grip for outputting a setup signal to the control unit 9A to instruct setting of the excavation area. Other suitable aid means such as a display may be provided on the control panel. As an alternative, the setting of the excavation area may be instructed by any of other suitable methods such as using 1C cards, bar codes, lasers, and wireless communication.

The mode switch 20 is, e.g., an alternate switch (switch holding its state after being changed over) selectively turned on or off by the operator. When the mode switch 20 is turned off, the speed precedence work mode is selected, and when it is turned on, the accuracy precedence work mode is selected.

The control unit 9A includes an area setting section and an area limiting excavation control section. The area setting section executes, in accordance with an instruction from the setting device 7, calculation for setting the excavation area where the tip of the bucket 1*c* is movable. One example of a manner of setting the excavation area will be described with reference to FIG. 3. Note that, in this embodiment, the excavation area is set in a vertical plane.

Figure 3:
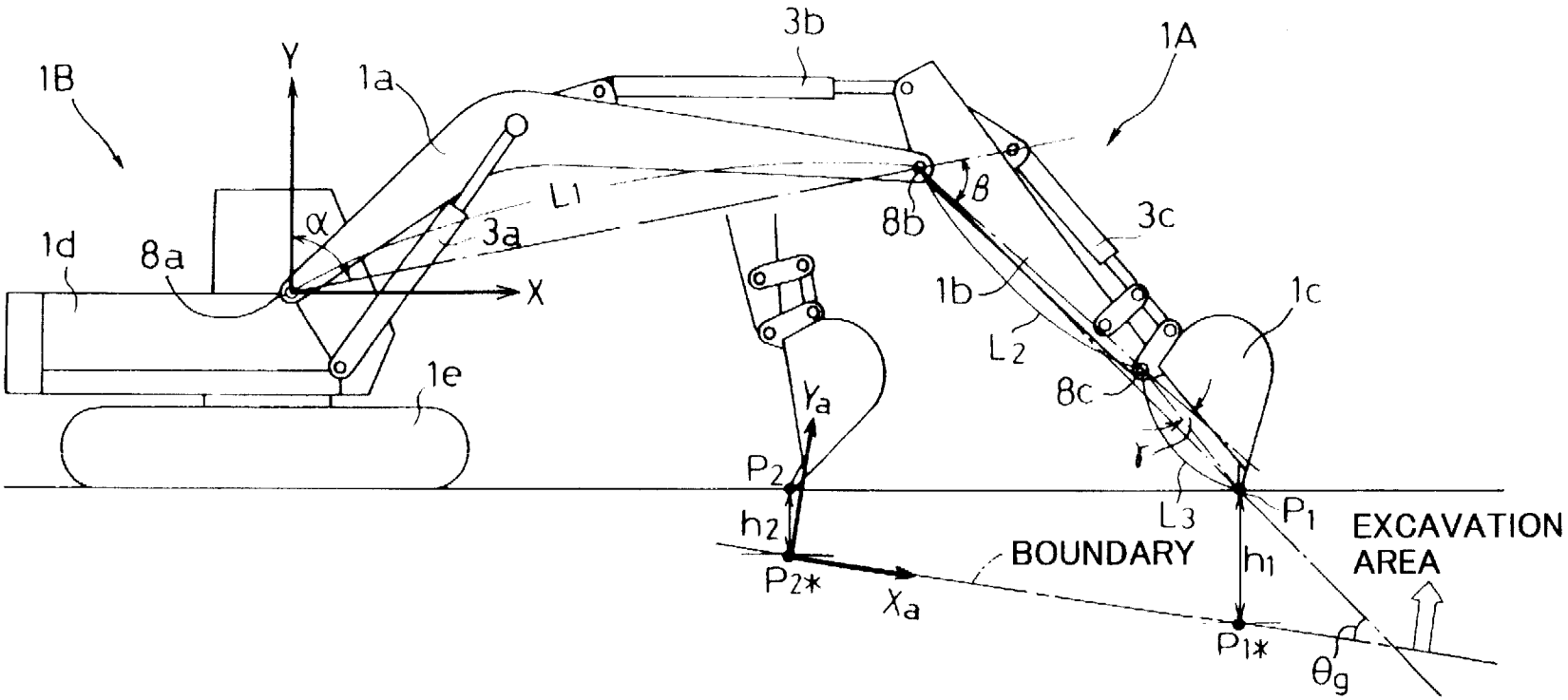
FIG. 3 is a view showing a manner of setting coordinate systems and an area for use in area limiting excavation control of the first embodiment.

In FIG. 3, after the tip of the bucket 1*c* has been moved to the position of a point P1 upon the operator manipulating the front device, the tip position of the bucket 1*c* at that time is calculated in response to an instruction from the setting device 7, and the setting device 7 is then operated to input a depth h1 from that position to designate a point P1* on the boundary of the excavation area to be set in terms of depth. Next, after moving the tip of the bucket 1*c* to the position of a point P2, in a like manner to the above, the tip position of the bucket 1*c* at that time is calculated in response to an instruction from the setting device 7, and the setting device 7 is then operated to input a depth h2 from that position to designate a point P2* on the boundary of the excavation area to be set in terms of depth. Then, a formula expressing a straight line connecting the two points P1* and P2* is calculated and the straight line is set as the boundary of the excavation area.

The control unit 9A stores various dimensions of the front device 1A and the body 1B in its memory, and the area setting section calculates the positions of the two points P1, P2 based on the stored data and values of rotational angles $\alpha$, $\beta$, $\gamma$ detected respectively by the angle sensors 8*a*, 8*b*, 8*c*. At this time, the positions of the two points P1, P2 are determined, by way of example, as coordinate values (X1, Y1), (X2, Y2) on an XY-coordinate system with the origin defined by the pivot point of the boom 1*a*. The XY-coordinate system is a rectangular coordinate system fixed on the body 1B and is assumed to lie in a vertical plane. Given that the distance between the pivot point of the boom 1*a* and the pivot point of the arm 1*b* is L1, the distance between the pivot point of the arm 1*b* and the pivot point of the bucket 1*c* is L2, and the distance between the pivot point of the bucket 1*c* and the tip of the bucket 1*c* is L3, the coordinate values (X1, Y1), (X2, Y2) on the XY-coordinate system are determined from the rotational angles α, β, γ by using formulae below:

$$X=L1\ \sin\alpha+L2\ \sin(\alpha+\beta)+L3\ \sin(\alpha+\beta+\gamma)$$

$$Y=L1\ \cos\alpha+L2\ \cos(\alpha+\beta)+L3\ \cos(\alpha+\beta+\gamma)$$

The area setting section determines the coordinate values of the two points P1*, P2* on the boundary of the excavation area by calculating their Y-coordinate values as follows:

$$Y1^*=Y1-h1$$

$$Y2^*=Y2-h2$$

The formula expressing the straight line connecting the two points P1* and P2* is obtained as follows:

$$Y=(Y2^*-Y1^*)X/(X2-X1)++(X2Y1^*-X1Y2^*)/(X2-X1)$$

Then, a rectangular coordinate system having the origin on the above straight line and one axis defined by the same straight line, for example, an XaYa-coordinate system with the origin defined by the point P2*, is set and transform data from the XY-coordinate system into the XaYa-coordinate system is determined.

Figure 4:
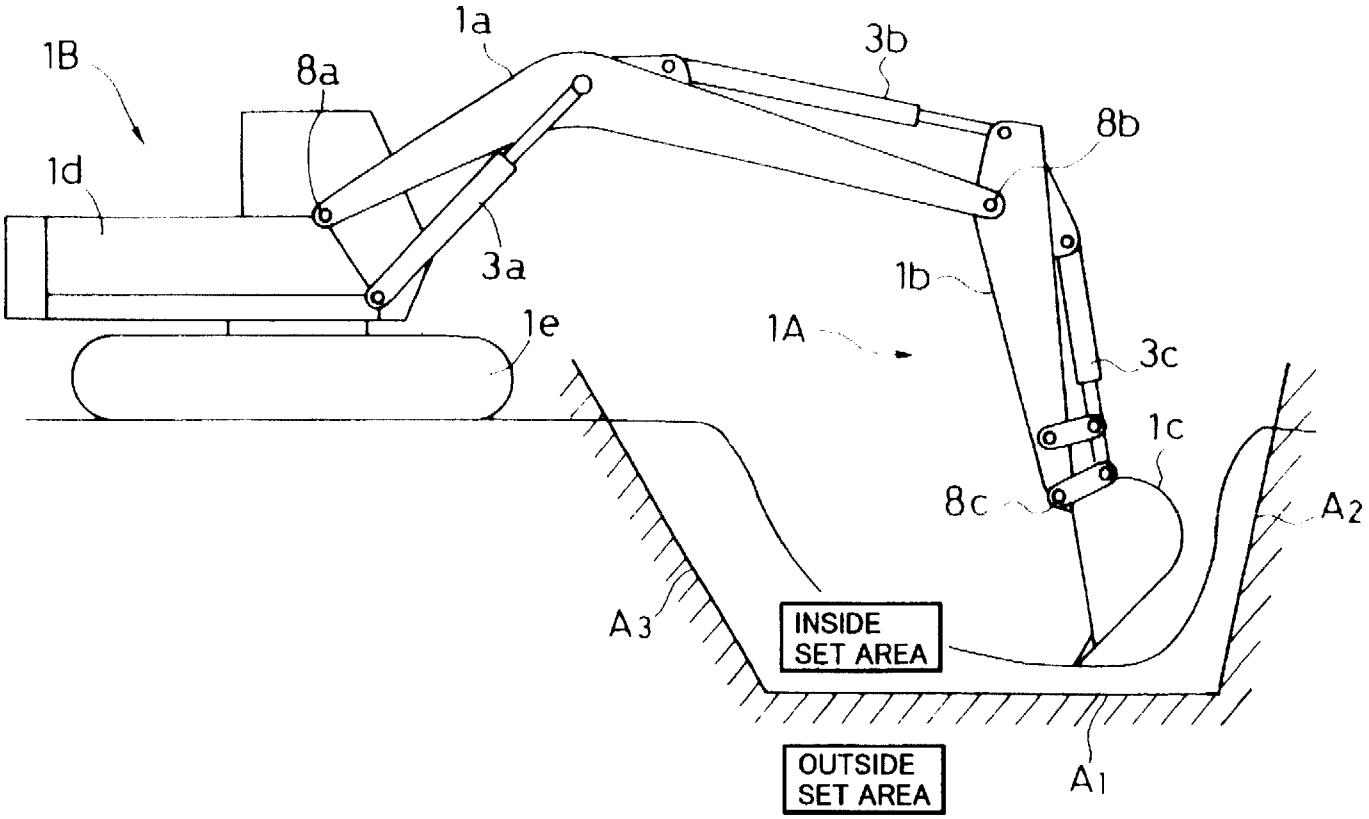
FIG. 4 is a view showing one example of the area set in the first embodiment.

While the boundary of the excavation area is set by a single straight line in the above example, the excavation area having any desired shape in a vertical plane can be set by combining a plurality of straight lines with each other. FIG. 4 shows one example of the latter case in which the excavation area is set by using three straight lines A1, A2 and A3. In this case, the boundary of the excavation area can be set by carrying out the same operation and calculation as mentioned above for each of the straight lines A1, A2 and A3.

The area limiting excavation control section in the control unit 9A executes, based on the area set through the above-described process (hereinafter referred to often as the set area), control for limiting the area where the front device 1A is movable, in accordance with a flowchart shown in FIG. 5. A description will now be made of the operation of this embodiment while explaining control functions of the area limiting excavation control section with reference to the flowchart of FIG. 5.

First, the operation signals Sa–Sf from the control lever units 14*a*–14*f* are input in step 200, and the rotational angles of the boom 1*a*, the arm 1*b* and the bucket 1*c* detected by the angle sensors 8*a*, 8*b*, 8*c* are input in step 210.

Then, in step 250, the position of a predetermined part of the front device 1A, e.g., the tip position of the bucket 1*c*, is calculated based on the detected rotational angles α, β, γ and the various dimensions of the front device 1A which are stored in the memory of the control unit 9A. At this time, similarly to the process executed above by the area setting section, the tip position of the bucket 1*c* is first calculated as values on the XY-coordinate system. These values on the XY-coordinate system are then transformed into values on the XaYa-coordinate system by using the transform data determined in the area setting section. Thus, the tip position of the bucket 1*c* is finally calculated as values on the XaYa-coordinate system.

Figure 6:
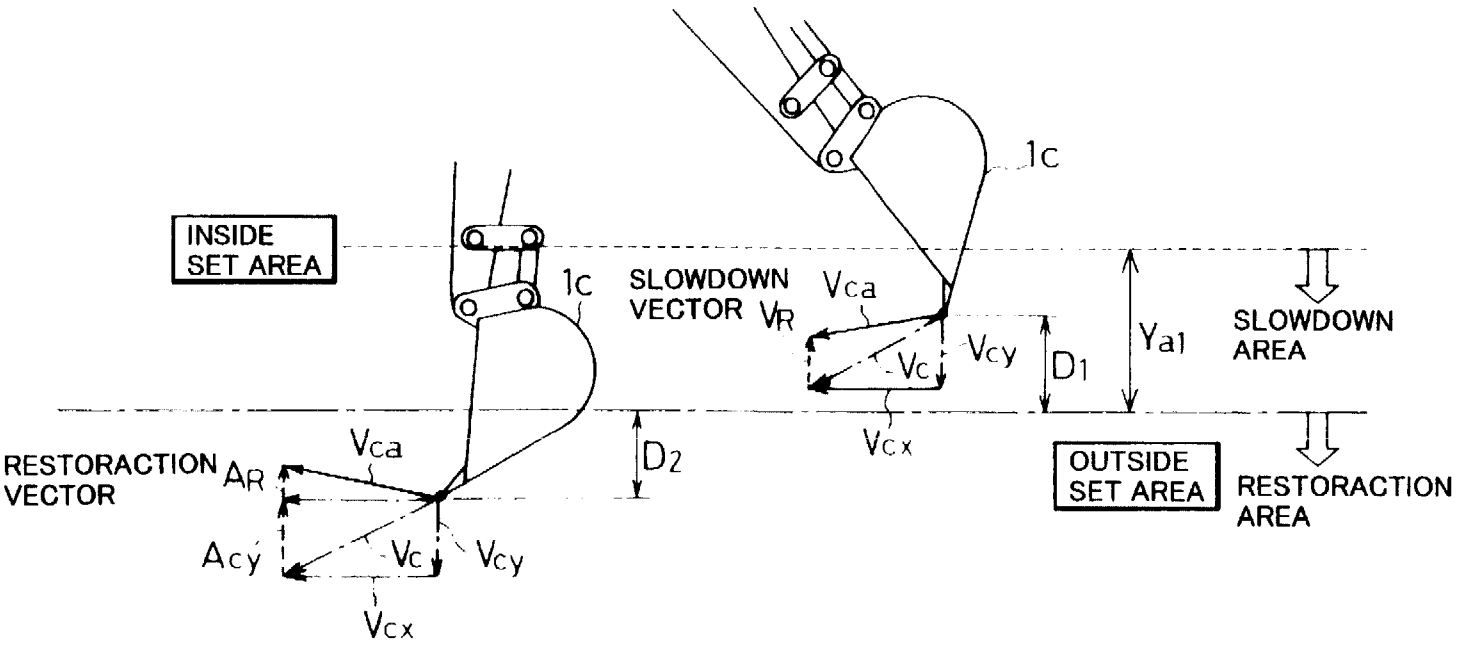
FIG. 6 is an illustration showing a manner of modifying a target speed vector in a slowdown area and a restoration area in the first embodiment.

Next, in step 255, it is determined whether or not the tip of the bucket 1*c* is in a slowdown area, shown in FIG. 6, locating within and near the boundary of the set area which has been set as described above. If the tip of the bucket 1*c* is in the slowdown area, the process flow goes to step 257 to determine whether the mode switch 20 is turned on or off. If the mode switch 20 is turned on, the process flow goes to step 260, and if it is turned off, the process flow goes to step 270.

In step 260, the control unit executes a process (hereinafter referred to often as a lever signal slowdown process) of reducing the operation signals Sa–Sc from the control lever units 14*a*–14*c* for the front device 1A.

In step 270, a target speed vector Vc at the tip of the bucket 1*c* instructed by the operation signals Sa–Sc from the control lever units 14*a*–14*c* which have been subjected to the slowdown process in step 260. The memory of the control unit 9A also stores the relationships between the operation signals Sa–Sc from the control lever units 14*a*–14*c* and supply flow rates through the flow control valves 15*a*–15*c*. Corresponding values of the supply flow rates through the flow control valves 15*a*–15*c* are determined from the operation signals Sa–Sc from the control lever units 14*a*–14*c*, target driving speeds of the hydraulic cylinders 3*a*–3*c* are determined from those values of the supply flow rates, and the target speed vector Vc at the bucket tip is calculated based on those target driving speeds and the various dimensions of the front device 1A. At this time, similarly to the calculation of the bucket tip position in step 250, the target speed vector Vc is calculated as values on the XaYa-coordinate system by first calculating the vector Vc as values on the XY-coordinate system and then converting those values into values on the XaYa-coordinate system by using the transform data determined in the area setting section. Here, an Xa-coordinate value Vcx of the target speed vector Vc on the XaYa-coordinate system represents a vector component of the target speed vector Vc in the direction parallel to the boundary of the set area, and a Ya-coordinate value Vcy represents a vector component of the target speed vector Vc in the direction vertical to the boundary of the set area.

Then, in step 280, the target speed vector Vc is modified so as to slow don the front device 1A, following which the process flow goes to step 290.

Further, if the tip of the bucket 1*c* is determined in step 255 as being not in the slowdown area, the process flow also goes to step 290 after a target speed vector Vc at the tip of the bucket 1*c* instructed by the original operation signals Sa–Sc from the control lever units 14*a*–14*c* is calculated in step 270A. The calculation of the target speed vector Vc in step 270A is the same as in step 270 except that the original operation signals Sa–Sc, which have not been subjected to the slowdown process, are used as the operation signals from the control lever units 14*a*–14*c*.

Then, it is determined in step 290 whether or not the tip of the bucket 1*c* is outside the set area, shown in FIG. 6, which has been set as explained above. If the bucket tip is outside the set area, the process flow goes to step 300 where the target speed vector Vc is modified so as to return the tip of the bucket 1*c* to the set area. If the bucket tip is not outside the set area, the process flow goes to step 310.

Then, in step 310, operation signals Sa–Sc for the flow control valves 15*a*–15*c* corresponding to a target speed vector Vca after modification obtained in step 280 or 300 are calculated. This process is a reversal of the calculation of the target speed vector Vc executed in step 260.

Then, in step 320, the control unit outputs the operation signals Sa–Sf input in step 200, or the operation signals Sa–Sc calculated in step 310 and the operation signals Sd–Sf input in step 200, followed by returning to the start.

A description will now be made of the determination in step 255 as to whether or not the bucket tip is in the slowdown area, the slowdown process of the operation signals Sa–Sc in step 260, and the modification of the target speed vector Vc for slowdown control in step 280 with reference to FIGS. 7 to 12.

The memory of the control unit 9A stores, as a value for setting a range of the slowdown area, the distance Ya1 from the boundary of the set area as shown in FIG. 6. In step 255, from the Ya-coordinate value of the tip position of the bucket 1*c* determined in step 250, a distance D1 between the bucket tip position and the boundary of the set area is determined. Then, if the distance D1 is smaller then the distance Ya1, it is determined that the bucket tip has entered the slowdown area.

Figure 7:
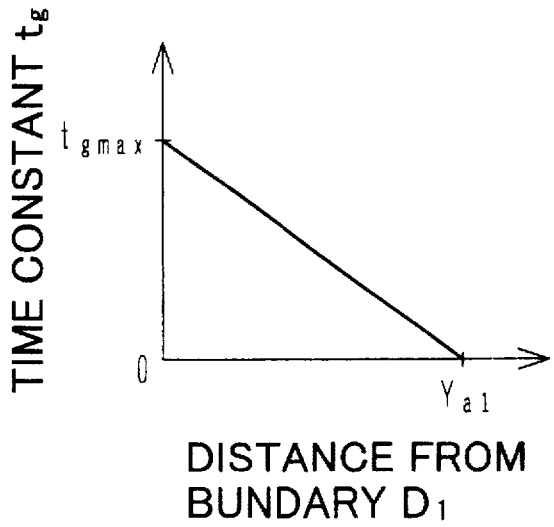
FIG. 7 is a graph showing the relationship between a distance from a bucket tip to a boundary of the set area and a time constant.
Figure 8:
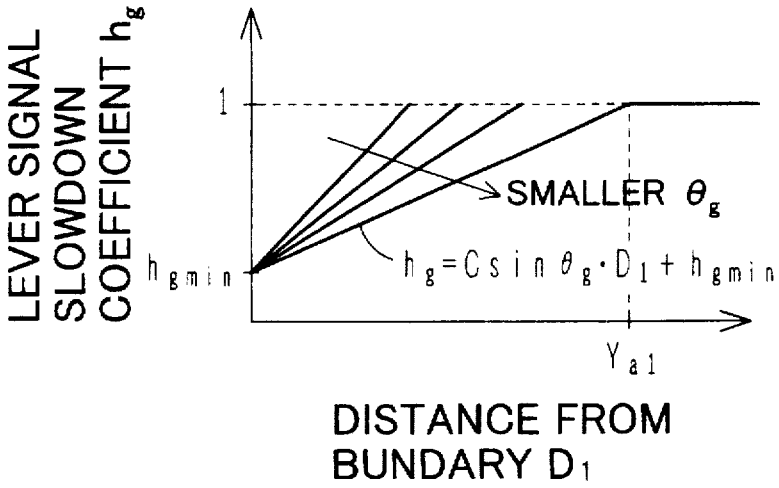
FIG. 8 is a graph showing the relationship between the distance from the bucket tip to the boundary of the set area and a slowdown coefficient.

The memory of the control unit 9A also stores the relationship between the distance D1 from the tip of the bucket 1*c* to the boundary of the set area and a time constant tg as shown in FIG. 7, and the relationship between the distance D1 and a lever signal slowdown coefficient hg as shown in FIG. 8. The relationship between the distance D1 and the time constant tg is set such that when the distance D1 is larger than the distance Ya1, the time constant tg is equal to 0 (tg=0), and when D1 is smaller than Ya1, the time constant tg is increased as the distance D1 decreases and then takes a maximum value (tg=tgmax) at the distance D1=0. Also, the relationship between the distance D1 and the slowdown coefficient hg is set such that when the distance D1 is larger than the distance Ya1, the slowdown coefficient hg is equal to 1 (hg=1), and when D1 is smaller than Ya1, the slowdown coefficient hg is reduced in accordance with the following formula;

$$hg=C\sin(\theta g)\cdot D1+hgmin$$

as the distance D1 decreases and then takes a minimum value (hg=hgmax (≠0)) at the distance D1=0. In the above formula, C is a constant and θg is an angle formed by a straight line connecting the tip of the bucket 1*c* and an arm pin about which the arm 1*b* is pivotable (i.e., a position in which the angle sensor 8*b* is mounted) relative to the boundary of the excavation area, as shown in FIG. 3. In other words, at the smaller angle θg, the slowdown coefficient hg starts to reduce at an earlier time (from a position farther away from the boundary of the excavation area).

Figure 9:
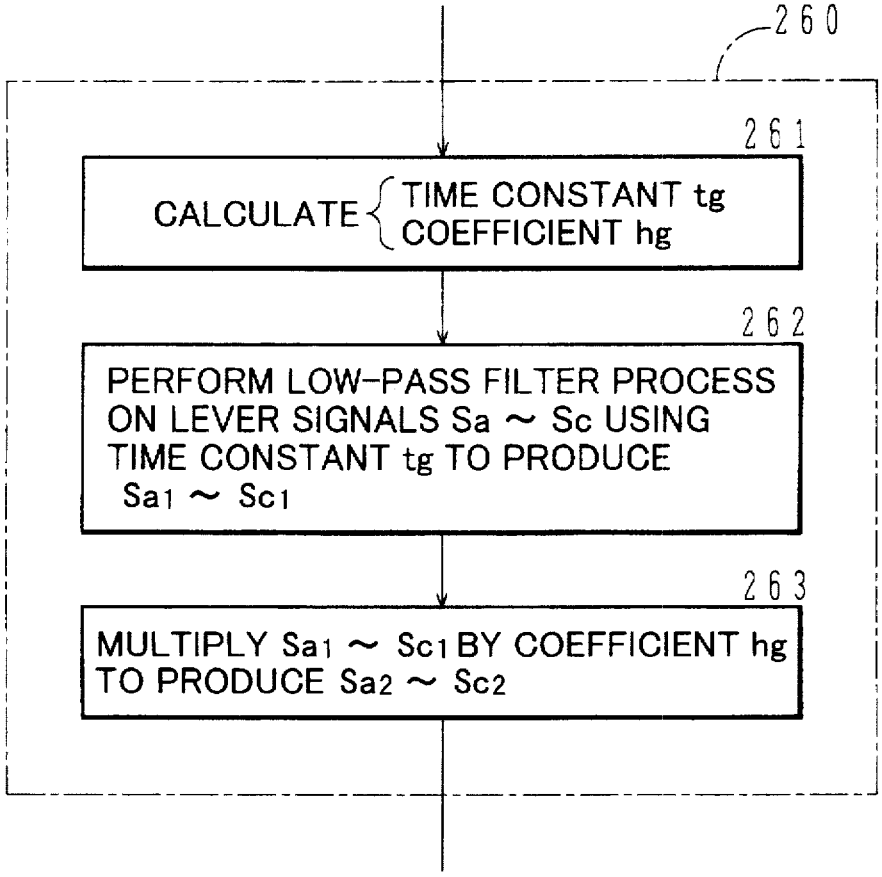
FIG. 9 is a flowchart showing details of lever signal slowdown control.

In step 260, as shown in FIG. 9, the time constant tg and the slowdown coefficient hg at the present time are both first calculated in step 261 from the distance D1 determined in step 255 and the relationships shown in FIGS. 7 and 8. At this time, because the slowdown coefficient hg is, as stated above, a function of the angle θg which is formed by the straight line connecting the tip of the bucket 1*c* and the pivot center of the arm 1*b* relative to the boundary of the excavation area, the angle θg is first determined when calculating the slowdown coefficient hg. The angle θg is determinant by calculating the tip position of the bucket 1*c* and the position of the pivot center of the arm 1*b* based on the detected rotational angles α, β, γ and the various dimensions of the front device 1A which are stored in the memory of the control unit 9A, and then calculating it from the values of those positions and the formula of the straight line connecting the two points P1*, P2* which has been determined in the area setting section.

Then, in step 262, the low-pass filter process is performed on the operation signals Sa–Sc using the time constant tg, thereby producing first slowdown operation signals Sa1–Sc1. In step 263, the first slowdown operation signals Sa1–Sc1 are multiplied by the slowdown coefficient hg to produce second slowdown operation signals Sa2–Sc2.

Figure 10:
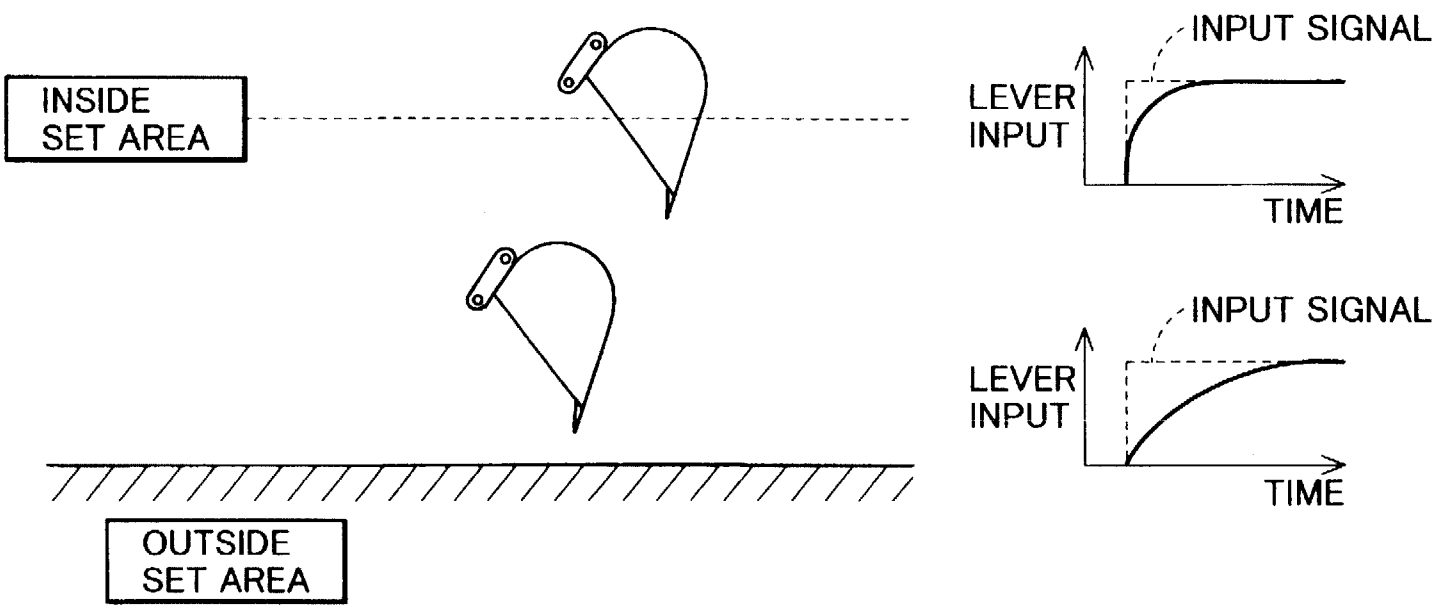
FIG. 10 is an illustration showing change in lever input through a low-pass filter process.

Here, the low-pass filter process in step 262 is performed in accordance with a calculation formula below:

$$\text{output}=x_{n-1}+(1-e^{-aT})(x_n-x_{n-1})$$

where $x_n$: operation signal input during previous sampling time $x_{n-1}$: output value during previous sampling time a=1/tg T=cycle time Carrying out the low-pass filter process on the operation signals Sa–Sc in step 262 means that the input original operation signals Sa–Sc having a step-like waveform are modified into the first slowdown operation signals Sa1–Sc1 rising more slowly, as shown in FIG. 10, and results in that the lever operation is slowed down apparently. Also, increasing the time constant tg for use in the low-pass filter process as the distance D1 decreases means that the first slowdown operation signals Sa1–Sc1 are forced to rise more slowly as the tip of the bucket 1*c* comes closer to the boundary of the excavation area. Thus, an amount of level reduction in rising of the operation signals Sa–Sc is gradually increased as the tip of the bucket 1*c* comes closer to the boundary of the excavation area.

Further, multiplying the first slowdown operation signals Sa1–Sc1 by the slowdown coefficient hg in step 263 means that because hg takes a smaller value as the distance D1 decreases, the second slowdown operation signals Sa2–Sc2 are reduced as the tip of the bucket 1*c* comes closer to the boundary of the excavation area. Also, in this case, an amount of reduction in level of the operation signals Sa–Sc is gradually increased as the tip of the bucket 1*c* comes closer to the boundary of the excavation area. In addition, hg is a sine function of the angle θg formed by the straight line connecting the tip of the bucket 1*c* and the pivot center of the arm 1*b* relative to the boundary of the excavation area, as stated above, and it takes a smaller value at the smaller angle θg. Therefore, as the front device 1A is extended to a farther position, the second slowdown operation signals Sa2–Sc2 become smaller to reduce the operation signals Sa–Sc in a larger amount. Accordingly, the operation signals Sa–Sc are reduced in a larger amount when the operation is carried out in a further extended condition of the front device 1A in which the speed vector at the tip of the bucket 1*c* has a greater component in the direction toward the boundary of the excavation area and the tip end of the front device is more likely to go out of the excavation area.

Figure 11:
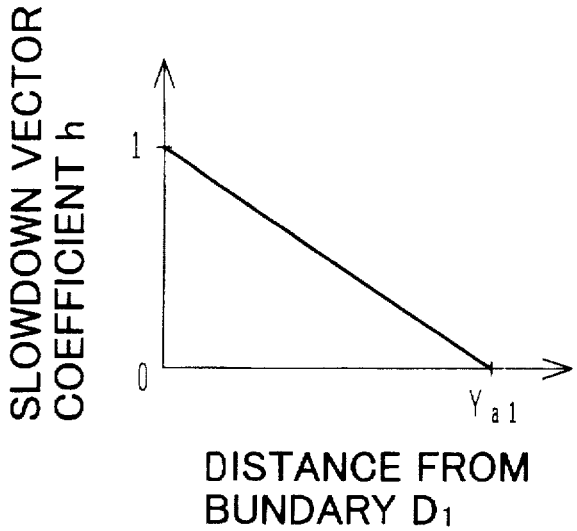
FIG. 11 is a graph showing the relationship between the distance from the bucket tip to the boundary of the set area and a slowdown vector coefficient.

The memory of the control unit 9A also stores the relationship between the distance D1 from the tip of the bucket 1*c* to the boundary of the set area and a slowdown vector coefficient h as shown in FIG. 11. The relationship between the distance D1 and the coefficient h is set such that the coefficient h is equal to 0 (h=0) when the distance D1 is larger than the distance Ya1, is gradually increased as the distance D1 decreases when D1 is smaller than Ya1, and is equal to 1 (h=1) at the distance D1=0.

In step 280, the target speed vector Vc is modified so as to reduce the vector component of the target speed vector Vc at the tip of the bucket 1*c* in the direction toward the boundary of the set area, i.e., the vector component thereof vertical to the boundary of the set area, that is to say, the Ya-coordinate value Vcy on the XaYa-coordinate system, which has been calculated in step 270. More specifically, the slowdown vector coefficient h corresponding to the distance D1 determined in step 255 is calculated from the relationship, shown in FIG. 11, stored in the memory of the control unit 9A. The Ya-coordinate value (vertical vector component) Vcy of the target speed vector Vc is multiplied by the calculated slowdown vector coefficient h and further multiplied by—1 to obtain a slowdown vector VR (=–hvcy). VR is then added to Vcy. Here, the slowdown vector VR is a speed vector which orients in opposed relation to Vcy and which is gradually increased as the distance D1 from the tip of the bucket 1c to the boundary of the set area decreases from Ya1 and then becomes equal to—Vcy (VR=–Vcy) at D1=0. By adding the slowdown vector VR to the vertical vector component Vcy of the target speed vector Vc, therefore, the vertical vector component Vcy is reduced such that an amount of reduction in the vertical vector component Vcy is gradually increased as the distance D1 decreases from Ya1. As a result, the target speed vector Vc is modified into a target speed vector Vca.

Figure 12:
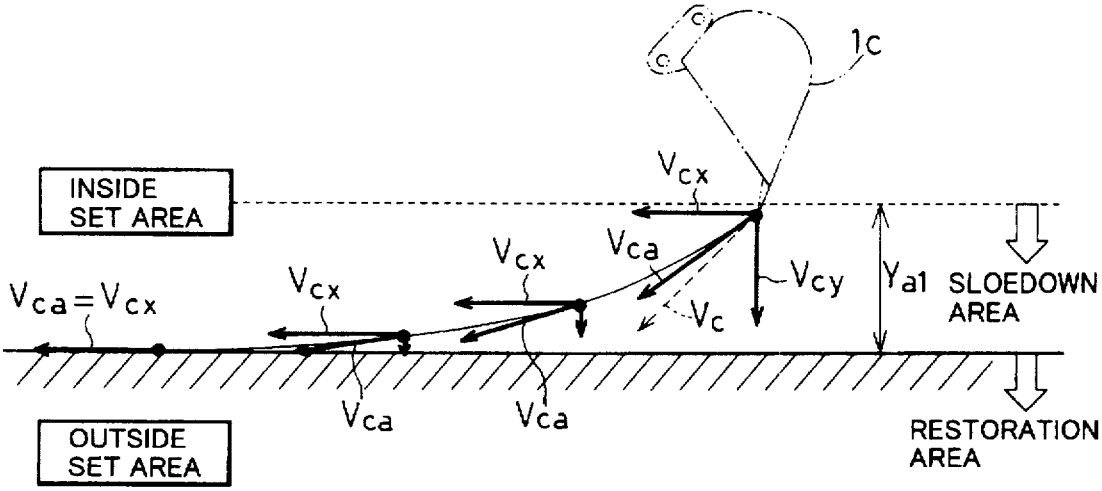
FIG. 12 is a diagram showing one example of a path along which the bucket tip is moved under direction change control.

FIG. 12 shows one example of a path along which the tip of the bucket 1c is moved when the slowdown control is performed as per the above-described target speed vector Vca after modification. More specifically, given that the target speed vector Vc is oriented downward obliquely and constant, its parallel component Vcx remains the same and its vertical component Vcy is gradually reduced as the tip of the bucket 1c comes closer to the boundary of the set area (i.e., as the distance D1 decreases from Ya1). Because the target speed vector Vca after modification is a resultant of both the parallel and vertical components, the path is in the form of a curved line which is curved so as to become parallel by degrees while approaching the boundary of the set area, as shown in FIG. 12. Also, because of h=1 and VR=–Vcy at D1=0, the target speed vector Vca after modification on the boundary of the set area coincides with the parallel component Vcx.

Thus, in the slowdown control in step 280, since the movement of the tip of the bucket 1c toward the boundary of the set area is slowed down, the direction in which the tip of the bucket 1c is moving is eventually converted into the direction along the boundary of the set area. From this point of view, the slowdown control in step 280 can also be called direction change control.

A description will now be made of the determination in step 290 as to whether or not the bucket tip is outside the set area, and the modification of the target speed vector Vc for restoration control outside the set area in step 300 with reference to FIGS. 13 and 14.

In step 290, from the Ya-coordinate value of the tip position of the bucket 1c determined in step 250, a distance D2 between the bucket tip position outside the set area and the boundary of the set area is determined. If a value of the distance D2 changes from negative to positive, it is determined that the bucket tip has moved out of the set area.

Figure 13:
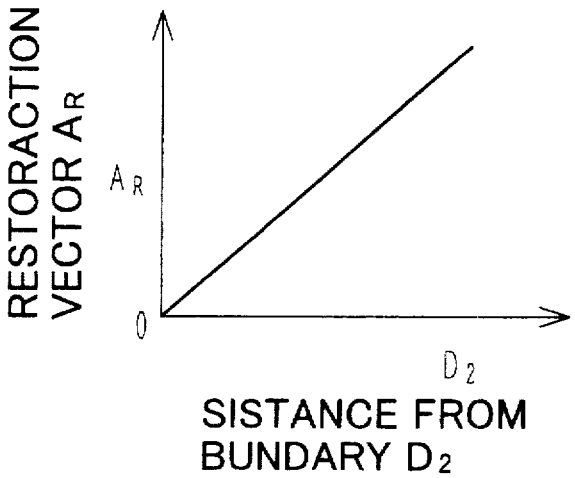
FIG. 13 is a graph showing the relationship between the distance from the bucket tip to the boundary of the set area and a restoration vector.

The memory of the control unit 9A further stores the relationship between the distance D2 from the tip of the bucket 1c to the boundary of the set area and a restoration vector AR as shown in FIG. 13. The relationship between the distance D2 and the restoration vector AR is set such that the restoration vector AR is gradually increased as the distance D2 increases.

In step 300, the target speed vector Vc is modified such that the vector component of the target speed vector Vc at the tip of the bucket 1c in the direction vertical to the boundary of the set area which has been calculated in step 270, i.e., the Ya-coordinate value Vcy on the XaYa-coordinate system, is changed to a vertical component in the direction toward the boundary of the set area. More specifically, a reversed vector Acy of Vcy is added to the vertical vector component Vcy to cancel it, and the parallel vector component Vcx is extracted. With this modification, the tip of the bucket 1c is prevented from further moving out of the set area. Then, the restoration vector AR corresponding to the distance D2 between the tip of the bucket 1c and the boundary of the set area at that time is calculated from the relationship, shown in FIG. 13, stored in the memory. The calculated restoration vector AR is set to a vertical vector Vcya of the target speed vector Vc. Here, the restoration vector AR is a reversed speed vector which is gradually reduced as the distance D2 between the tip of the bucket 1c and the boundary of the set area decreases. By setting the restoration vector VR to the vertical vector component Vcy of the target speed vector Vc, therefore, the target speed vector Vc is modified into a target speed vector Vca of which vertical vector component Vcya is gradually reduced as the distance D2 decreases.

Figure 14:
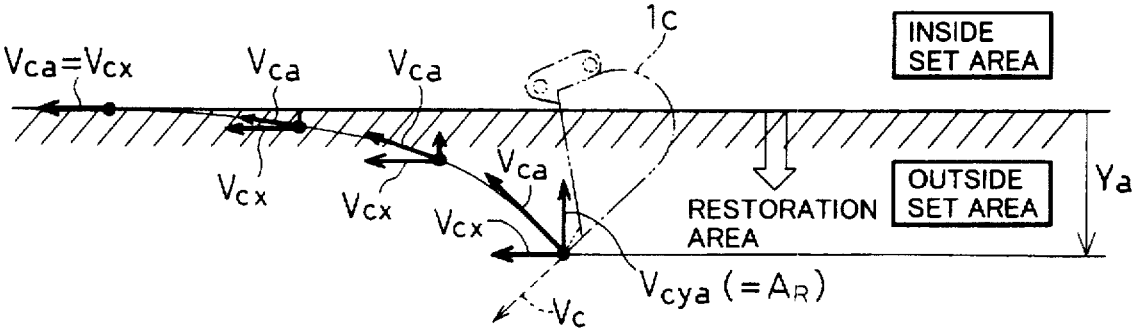
FIG. 14 is a diagram showing one example of a path along which the bucket tip is moved under restoration control.

FIG. 14 shows one example of a path along which the tip of the bucket 1c is moved when the restoration control is performed as per the above-described target speed vector Vca after modification. More specifically, given that the target speed vector Vc is oriented downward obliquely and constant, its parallel component Vcx remains the same, and since the restoration vector AR is in proportion to the distance D2, its vertical component Vcy is gradually reduced as the tip of the bucket 1c comes closer to the boundary of the set area (i.e., as the distance D1 decreases from Ya1). Because the target speed vector Vca after modification is a resultant of both the parallel and vertical components, the path is in the form of a curved line which is curved so as to become parallel by degrees while approaching the boundary of the set area, as shown in FIG. 14.

Thus, in the restoration control in step 300, since the tip of the bucket 1c is controlled to return to the set area, a restoration area is defined outside the set area. Further, in the restoration control, the movement of the tip of the bucket 1c toward the boundary of the set area is likewise slowed down and, eventually, the direction in which the tip of the bucket 1c is moving is converted into the direction along the boundary of the set area. From this point of view, the restoration control can also be called direction change control.

In the above arrangement, the control lever units 14a–14f constitute a plurality of operating means for instructing operations of the plurality of driven members, i.e., the boom 1a, the arm 1b, the bucket 1c, the upper structure 1d and the undercarriage 1e. The setting device 7 and the function of the area setting section in the control unit 9A constitute area setting means for setting an area where the front device 1A is movable. The angle sensors 8a–8c constitute first detecting means for detecting status variables in relation to the position and posture of the front device 1A. The step 250 in FIG. 5 constitutes first calculating means for calculating the position and posture of the front device 1A based on signals from the angle sensors 8a–8c as the first detecting means for detecting status variables in relation to the position and posture of the front device 1A. Further, supposing that the arm 1b is a first particular front member and the boom 1a is a second particular front member, the step 260 constitutes first signal modifying means for modifying, based on the values calculated by the first calculating means 250, at least the operation signal Sb from the control lever unit 14b associated with the first particular front member 1b among the plurality of lever control units 14a–14f (the operation signals Sa–Sc in this embodiment), when the front device 1A is near the boundary of the set area therewithin. The steps 270 and 280 constitute second signal modifying means for calculating, based on at least the operation signals Sa2–Sc2 reduced by the first signal modifying means 260 and the values calculated by the first calculating means 250, a speed Vc for control of the front device 1A, and modifying, based on the speed Vc for control, at least the operation signal Sa from the control lever unit 14*a* associated with the second particular front member 1*a* among the plurality of lever control units 14*a*–14*f* (the operation signals Sa–Sc in this embodiment), such that the moving speed of the front device in the direction toward the boundary of the set area is reduced within the set area.

Figure 5:
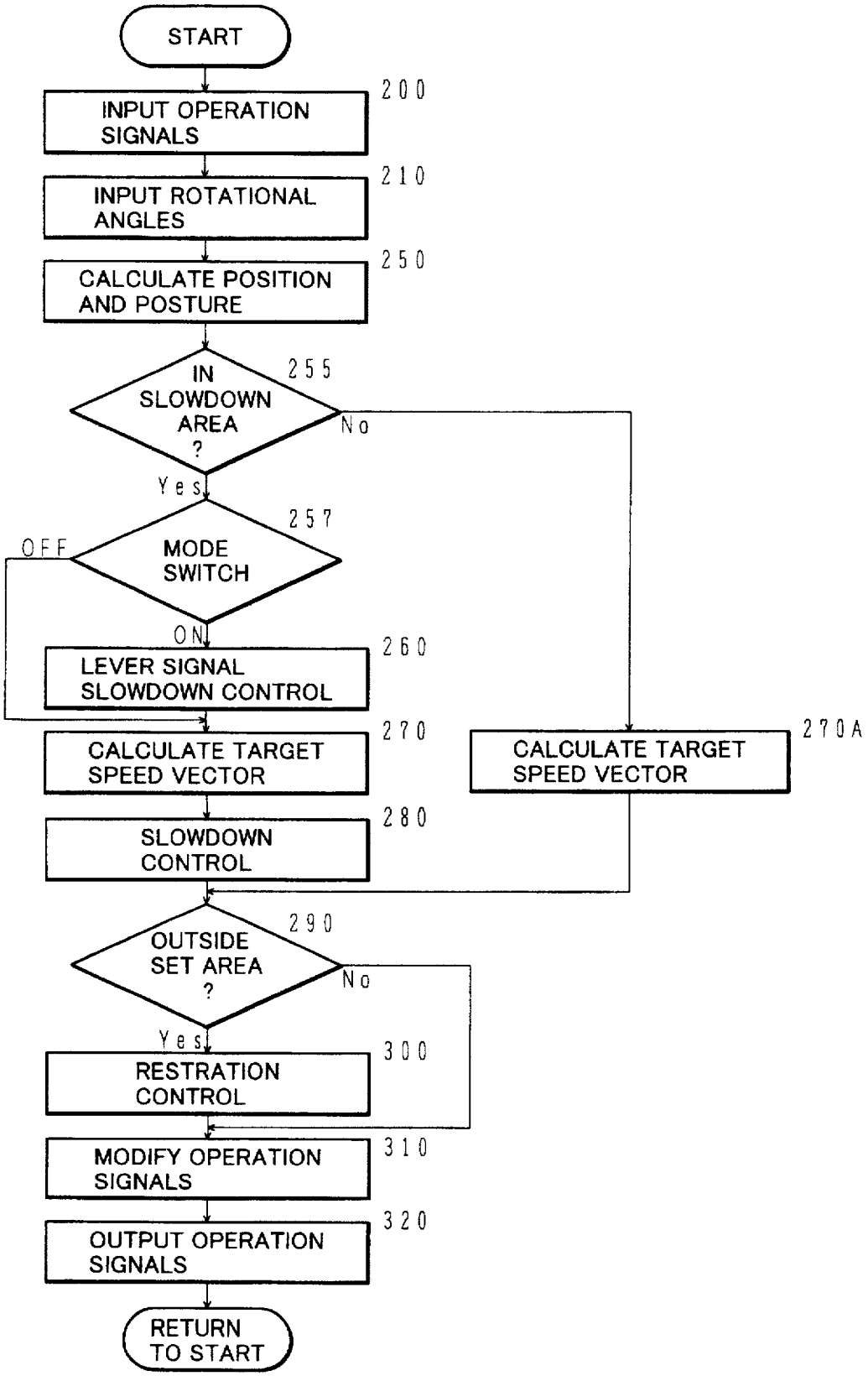
FIG. 5 is a flowchart showing control steps executed in a control unit.

Also, the mode switch 20 and the step 257 in FIG. 5 constitute mode selecting means for selecting whether or not the operation signals Sa–Sc of the control lever units 14*a*–14*c* are modified to be reduced by the first signal modifying means. When the mode selecting means 20, 257 is operated to select no modification by the first signal modifying means, the first signal modifying means 260 does not modify the operation signals Sa–Sc and the second signal modifying means 270, 280 calculates, based on at least the operation signals Sa–Sc not modified and the values calculated by the first calculating means 250, the speed Vc for control of the front device 1A, and modifies, based on the speed Vc for control, at least the operation signal Sa from the control lever unit 14*a* (the operation signals Sa–Sc in this embodiment) associated with the second particular front member 1*a*.

With this embodiment constructed as described above, when the tip of the bucket 1*c* is away from the boundary of the set area, the target speed vector Vc is not modified in step 270A and the work can be implemented in a normal manner. When the tip of the bucket 1*c* comes closer to the boundary of the set area within it, the target speed vector Vc is modified in step 280 such that the vector component in the direction toward the boundary of the set area (i.e., the vector component vertical to the boundary) is reduced. Therefore, the movement of the bucket tip in the direction vertical to the boundary of the set area is controlled to slow down, while the speed component in the direction along the boundary of the set area is not reduced, enabling the tip of the bucket 1*c* to be moved along the boundary of the set area as shown in FIG. 12. It is thus possible to efficiently perform excavation while limiting a area where the tip of the bucket 1*c* is movable.

When the accuracy precedence work mode is selected by the mode switch 20, the operation signals Sa–Sc from the control lever units 14*a*–14*c* are subjected to the low-pass filter process and the lever signal slowdown process in step 260 through which the operation signals Sa–Sc themselves are reduced depending on the distance between the tip position of the bucket 1*c* and the boundary of the set area. Then, the operation signals Sa2–Sc2 resulted through those processes are modified in step 280 as stated above. When the speed precedence work mode is selected by the mode switch 20, the operation signals Sa–Sc from the control lever units 14*a*–14*c* are directly modified in step 280 as stated above without being reduced. Thus, in any case, the slowdown control (direction change control) is performed in step 280.

Because of the direction change control being carried out as speed control in step 280, if the speed of the front device 1A is extremely large, or if the control lever unit 14*b* is abruptly manipulated, the front device 1A may go out of the set area to a large extent due to a response delay in the control process, e.g., a delay in the hydraulic circuit, inertial force upon the front device 1A, and so on.

In this embodiment, by turning on the mode switch 20 to select the accuracy precedence work mode, the direction change control is performed in step 280 by using the operation signals Sa2–Sc2 which have been subjected to the low-pass filter process and the lever signal slowdown process in step 260. Therefore, even if the operation signals from the control lever units 14*a*–14*c* are extremely large, the overly quick movement of the front device 1A is suppressed as the tip of the bucket 1*c* approaches the boundary of the set area. Furthermore, even if the control lever units 14*a*–14*c* are abruptly manipulated, the hydraulic actuators 3*a*–3*c* are allowed to not only start moving smoothly, but also take a slower speed once started to move. This abates the effect of a response delay in the control process, e.g., a delay in the hydraulic circuit, and the effect of inertia. It is thus possible to reduce an amount by which the front device 1A projects out of the set area during the slowdown control in step 280, and to precisely move the front device 1A along the boundary of the set area.

Meanwhile, when the direction change control is performed in step 280 by using the operation signals Sa2–Sc2 which have been subjected to the low-pass filter process and the lever signal slowdown process in step 260, the working efficiency may drop because the quick movement of the front device 1A is suppressed even when the operator wants to move the front device 1A fast. In this embodiment, when the mode switch 20 is turned on to select the accuracy precedence work mode, the front device 1A can be moved while reducing an amount by which the front device 1A projects out of the set area, but when the mode switch 20 is turned off to select the speed precedence work mode, the front device 1A can be moved depending on the magnitudes of the operation signals Sa–Sc without dropping the working efficiency because the direction change control is performed in step 280 by using the operation signals Sa–Sc from the control lever units 14*a*–14*c* as they are.

With this embodiment, therefore, when implementing excavation work within a limited area, the operator can perform the work in an optimum mode selected from the accuracy precedence work mode in which an amount of projection of the bucket tip going out of the set area is small, and the speed precedence work mode in which the front device 1A can be moved fast, by changing over the mode switch 20 at his own discretion.

Also, with this embodiment, if the tip of the bucket 1*c* goes out of the set area to some extent during the direction change control in step 280, the target speed vector Vc is modified in step 300 causing the tip of the bucket 1*c* to return to the set area, whereby the bucket tip is controlled so as to promptly move back to the set area after having projected out of the set area. As a result, the excavation within a limited area can be implemented more precisely.

Further, with this embodiment, when the tip of the bucket 1*c* is controlled so as to move back to the set area, the vector component of the target speed vector Vc in the direction vertical to the boundary of the set area is modified into a vector component in the direction toward the boundary of the set area, while the speed component in the direction along the boundary of the set area is not reduced. Therefore, the tip of the bucket 1*c* can also be smoothly moved outside the set area along the boundary of the set area. In this connection, since the vector component in the direction toward the boundary of the set area is modified to become smaller as the distance D2 between the tip of the bucket 1*c* and the boundary of the set area decreases, the path along which the bucket tip is moved in accordance with the target speed vector Vca after modification during the restoration control is in the form of a curved line which is curved so as to become parallel by degrees while approaching the boundary of the set area, as shown in FIG. 14. As a result, the bucket tip can be moved back to the set area in a smoother manner.

A second embodiment of the present invention will be described with reference to FIGS. 15 to 25. In these figures, equivalent members to those in FIG. 1 are denoted by the same reference numerals.

Figure 15:
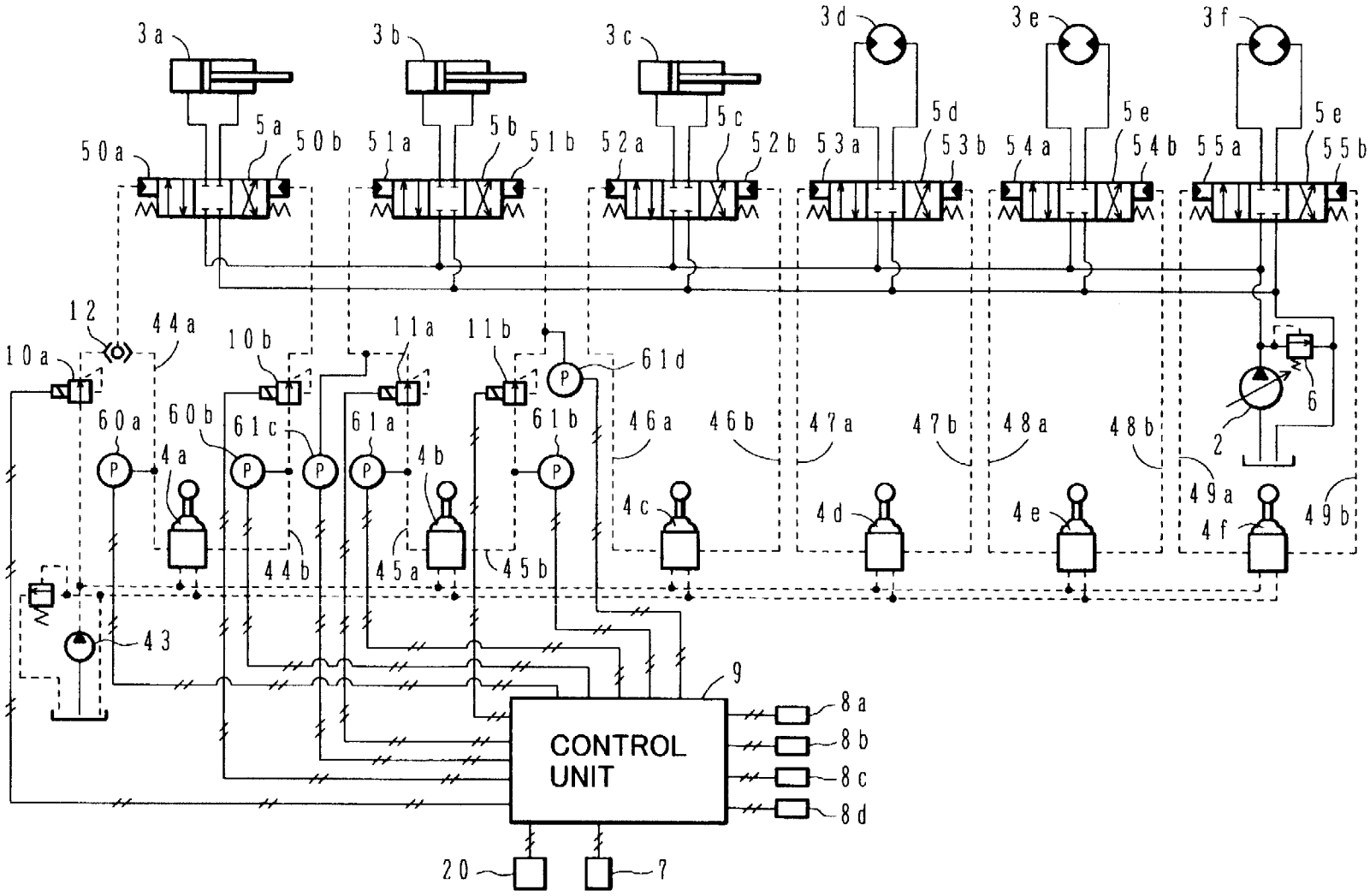
FIG. 15 is a diagram showing an area limiting excavation control system for construction machines according to a second embodiment of the present invention, along with a hydraulic drive system thereof.

Referring to FIG. 15, a hydraulic drive system equipped on a hydraulic excavator in which this embodiment is realized comprises a plurality of control lever units 4*a* to 4*f* provided respectively corresponding to the hydraulic actuators 3*a*–3*f*, and a plurality of flow control valves 5*a*–5*f* connected between the hydraulic pump 2 and the plurality of hydraulic actuators 3*a*–3*f* and controlled in accordance with respective operation signals from the control lever units 4*a*–4*f* for controlling respective flow rates of the hydraulic fluid supplied to the hydraulic actuators 3*a*–3*f*.

Figure 16:
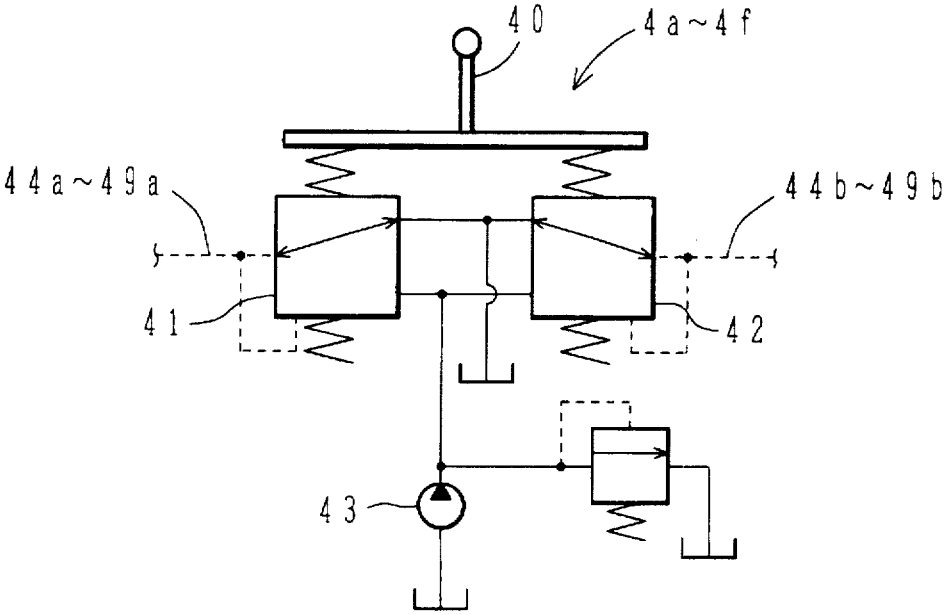
FIG. 16 is a view showing details of a control lever unit of hydraulic pilot type.

The control lever units 4*a*–4*f* are each of the hydraulic pilot type driving corresponding one of the flow control valves 5*a*–5*f* by a pilot pressure. Each of the control lever units 4*a*–4*f* comprises, as shown in FIG. 16, a control lever 40 manipulated by the operator, and a pair of pressure reducing valves 41, 42 for generating a pilot pressure depending on the input amount and the direction by and in which the control lever 40 is manipulated. The pressure reducing valves 41, 42 are connected at primary ports to a pilot pump 43, and at secondary ports to corresponding ones of hydraulic driving sectors 50*a*, 50*b*; 51*a*, 51*b*; 52*a*, 52*b*; 53*a*, 53*b*; 54*a*, 54*b*; 55*a*, 55*b* of the flow control valves through pilot lines 44*a*, 44*b*; 45*a*, 45*b*; 46*a*, 46*b*; 47*a*, 47*b*; 48*a*, 48*b*; 49*a*, 49*b*.

An area limiting excavation control system of this embodiment equipped in the hydraulic excavator constructed as explained above comprises, in addition to setting device 7, the mode switch 20 and the angle sensors 8*a*, 8*b*, 8*c*, a tilting angle sensor 8*d* for detecting a tilting angle θ of the body 1B in the forth-and-back direction, a proportional solenoid valve 10*a* connected at the primary port side to a pilot pump 43 for reducing a pilot pressure from the pilot pump 43 in accordance with an electric signal applied thereto and outputting the reduced pilot pressure, a shuttle valve 12 connected to the pilot line 44*a* of the control lever unit 4*a* for the boom and the secondary port side of the proportional solenoid valve 10*a* for selecting higher one of the pilot pressure in the pilot line 44*a* and the control pressure delivered from the proportional solenoid valve 10*a* and introducing the selected pressure to the hydraulic driving sector 50*a* of the flow control valve 5*a*, proportional solenoid valves 10*b*, 11*a*, 11*b* disposed in the pilot line 44*b* of the control lever unit 4*a* for the boom and the pilot lines 45*a*, 45*b* of the control lever unit 4*b* for the arm, respectively, for reducing the pilot pressures in the corresponding pilot lines in accordance with respective electric signals applied thereto and outputting the reduced pilot pressures, pressure sensors 60*a*, 60*b*; 61*a*, 61*b* disposed in the pilot lines 44*a*, 44*b*; 45*a*, 45*b* on the input side of the shuttle valve 12 and the primary port sides of the proportional solenoid valves 10*b*, 11*a*, 11*b* for detecting the respective pilot pressures as input amounts by which the control lever units 4*a*, 4*b* are manipulated, pressure sensors 61*c*, 61*d* disposed in the pilot lines 45*a*, 45*b* on the secondary port sides of the proportional solenoid valves 11*a*, 11*b* for detecting the respective pilot pressures applied from the proportional solenoid valves 11*a*, 11*b* to the hydraulic driving sectors 51*a*, 51*b* of the flow control valves 5*b*, and a control unit 9 for receiving a setup signal from the setting device 7, a selection signal from the mode switch 20, detection signals from the angle sensors 8*a*, 8*b*, 8*c* and the tilting sensor 8*d*, and detection signals from the pressure sensors 60*a*, 60*b*; 61*a*, 61*b*; 61*c*, 61*d*, and outputting electric signals to the proportional solenoid valves 10*a*–11*b*.

Figure 17:
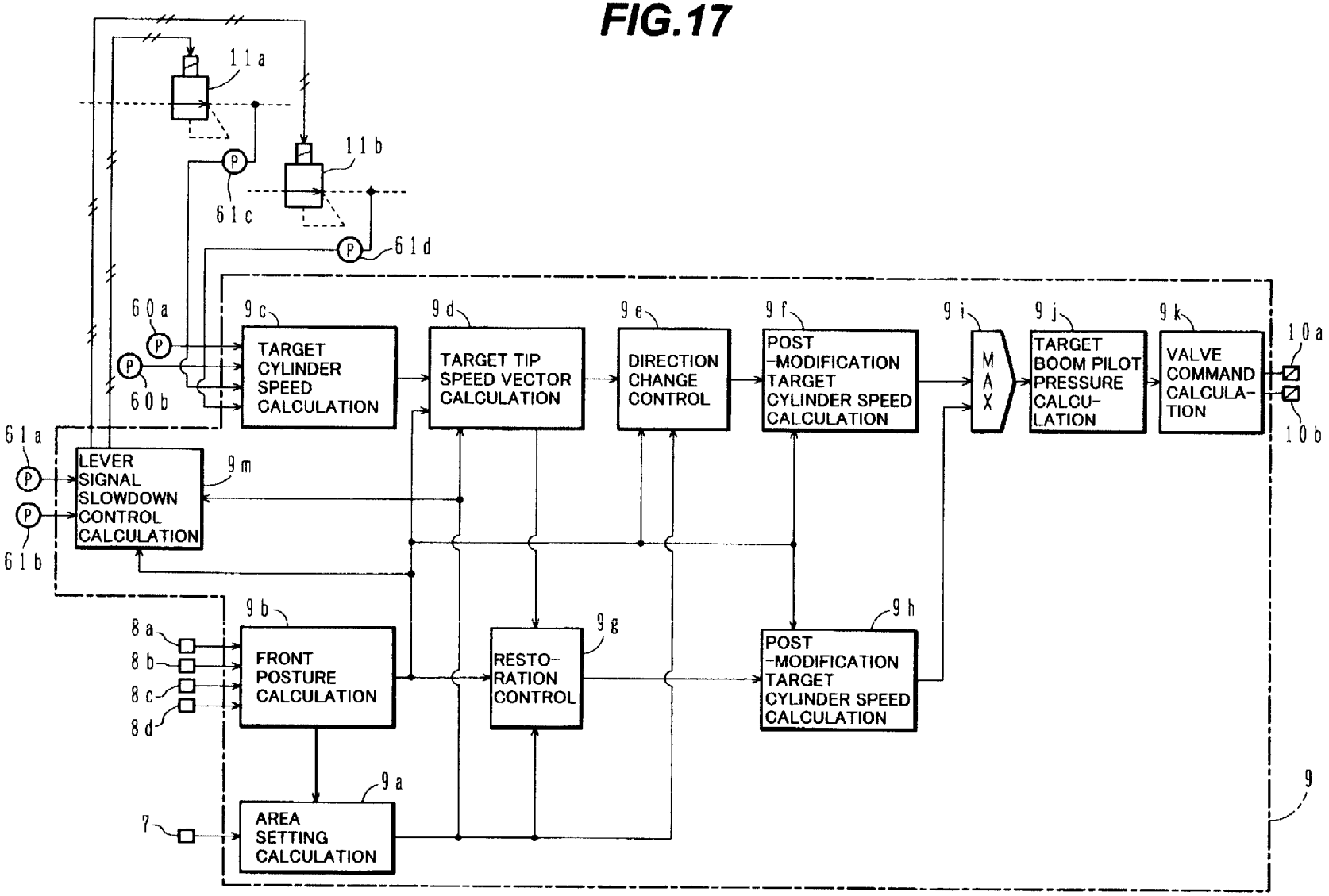
FIG. 17 is a functional block diagram showing control functions of a control unit.

Control functions of the control unit 9 are shown in FIG. 17. The control unit 9 includes various functions executed by an area setting calculating portion 9*a*, a front posture calculating portion 9*b*, a target cylinder speed calculating portion 9*c*, a target tip speed vector calculating portion 9*d*, a direction change control portion 9*e*, a post-modification target cylinder speed calculating portion 9*f*, a restoration control portion 9*g*, a post-modification target cylinder speed calculating portion 9*h*, a target cylinder speed selector 9*i*, a target pilot pressure calculating portion 9*j*, a valve command calculating portion 9*k*, and a lever signal slowdown processing portion 9*m*.

The area setting calculating portion 9*a* executes calculation for setting of the excavation area where the tip of the bucket 1*c* is movable, in accordance with an instruction from the setting device 7. A manner of setting the excavation area is the same as executed in the area setting section of the first embodiment described above with reference to FIG. 3. Thus, transform data from the XY-coordinate system to the XaYa-coordinate system having the origin and one axis on the boundary of the set area is determined (see FIG. 3).

Figure 18:
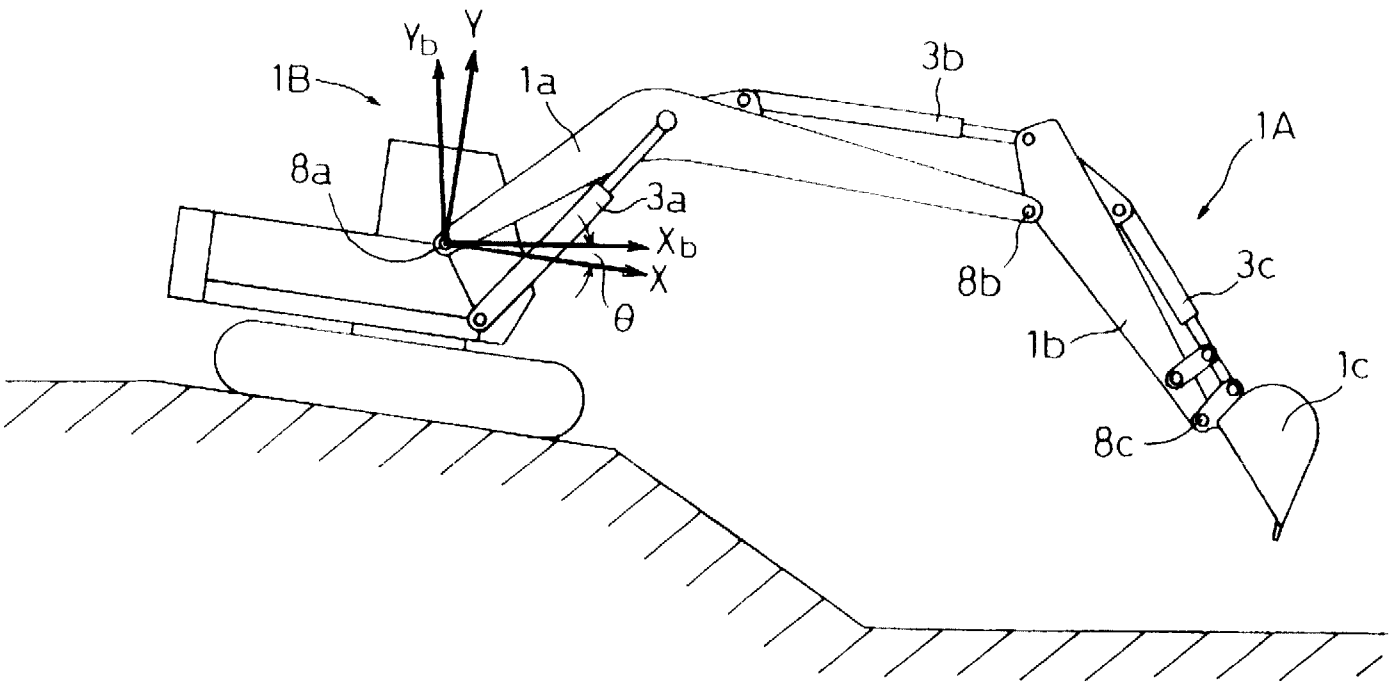
FIG. 18 is a view showing a manner of compensating a tilting angle.

When the body 1B is inclined as shown in FIG. 18, the relative positional relationship between the bucket tip and the ground surface is changed and the setting of the excavation area cannot be performed correctly. In this embodiment, therefore, a tilting angle θ of the body 1B is detected by the tilting angle sensor 8*d* and a detected value of the tilting angle θ is input to the front posture calculating portion 9*b* which calculates the tip position of the bucket on an XbYb-coordinate system which is provided by rotating the XY-coordinate system through the angle θ. This enables the excavation area to be correctly set even if the body 1B is inclined. Note that the tilting angle sensor is not always required when work is started after correcting a tilting of the body if the body is inclined, or when excavation is performed in the work site where the body will not incline.

The front posture calculating portion 9*b* calculates the position of a predetermined part of the front device 1A as values on the XY-coordinate system based on the various dimensions of the front device 1A and the body 1B which are stored in a memory of the control unit 9, as well as the values of the rotational angles α, β, γ detected respectively by the angle sensors 8*a*, 8*b*, 8*c*.

In the lever signal slowdown control portion 9*m*, it is determined whether or not the tip of the bucket 1*c* is in a slowdown area, shown in FIG. 6, locating within and near the boundary of the set area which has been set by the area setting calculating portion 9*a*. If the tip of the bucket 1*c* is in the slowdown area, the lever signal slowdown process is carried out to reduce the operation signal (pilot pressure) from the control lever unit 14*b* for the arm of the front device 1A when the accuracy precedence work mode is selected by the mode switch 20.

Figure 19:
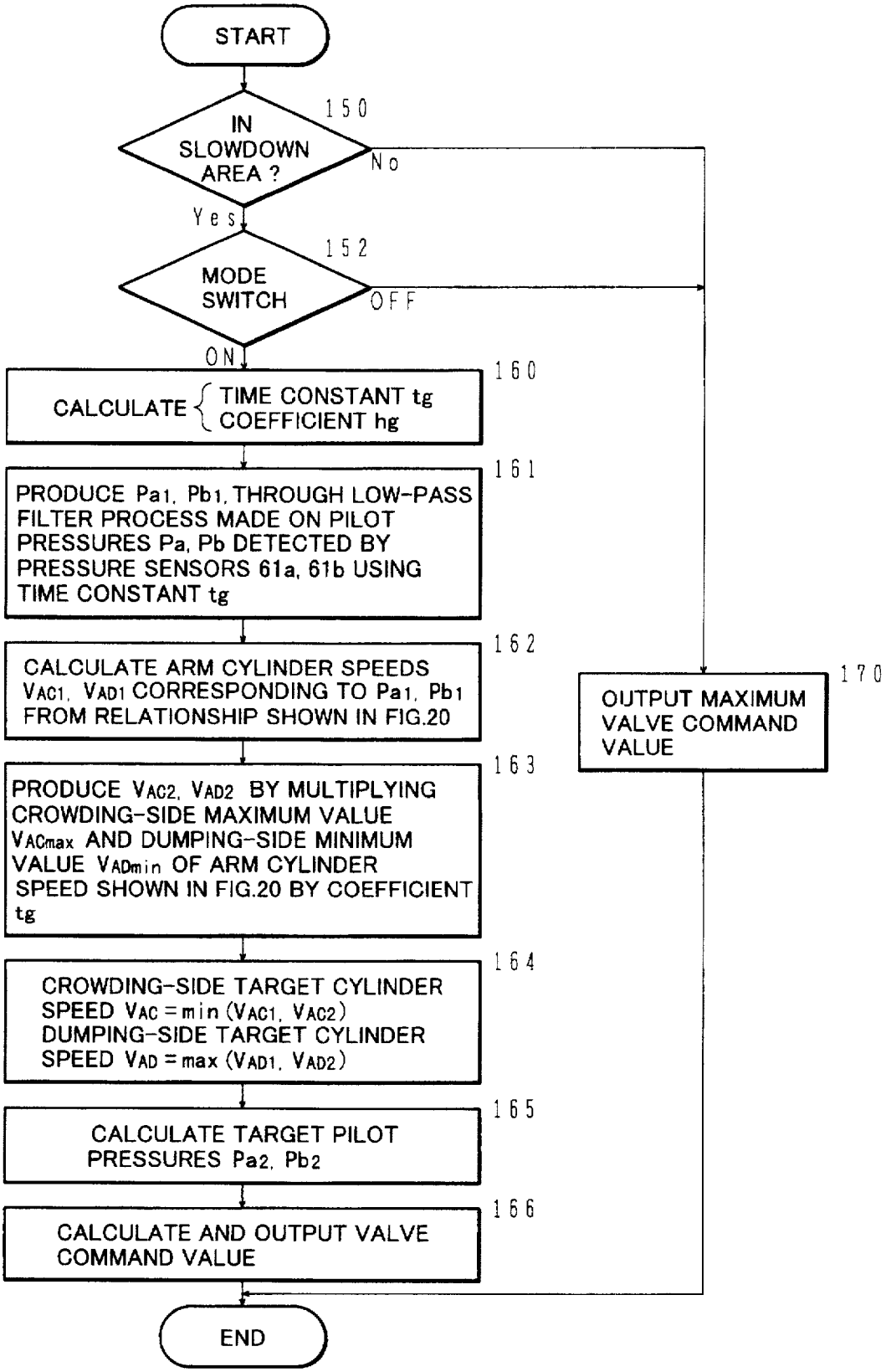
FIG. 19 is a flowchart showing details of control steps executed in a lever slowdown control portion.

FIG. 19 is a flowchart showing processing steps executed in the lever signal slowdown control portion 9*m*. First, in step 150, it is determined whether or not the tip of the bucket 1*c* has entered the slowdown area. The memory of the control unit 9 stores, as a value for setting a range of the slowdown area, the distance Ya1 from the boundary of the set area as shown in FIG. 6. Specifically, in step 150, the tip position of the bucket 1*c* determined by the front posture calculating portion 9*b* on the XY-coordinate system is transformed into values on the XaYa-coordinate system by using the transform data obtained in the area setting calculating portion 9*a*, and a distance D1 between the tip position of the bucket 1*c* within the set area and the boundary of the set area is determined from the Ya-coordinate value resulted for the bucket tip position. Then, if the distance D1 is smaller than the distance Ya1, it is determined that the bucket tip has entered the slowdown area. If the bucket tip is determined in step 150 as having entered the slowdown area, the process flow goes to step 152 to determine whether the mode switch 20 is turned on or off. If the mode switch 20 is turned on, the process flow goes to step 160.

In step 160, the time constant tg and the slowdown coefficient hg are calculated. This calculation of tg and hg is the same as in the first embodiment and hence will not described below.

The process flow then goes to step 161. Given that the pilot pressures detected as arm operation signals by the pressure sensors 61*a*, 61*b* are Pa, Pb, the low-pass filter process is executed in step 161 on the pilot pressures Pa, Pb by using the time constant tg to produce modified pilot pressures Pa1, Pb1. This calculation in the low-pass filter process is also the same as in the first embodiment and hence will not described below.

Figure 20:
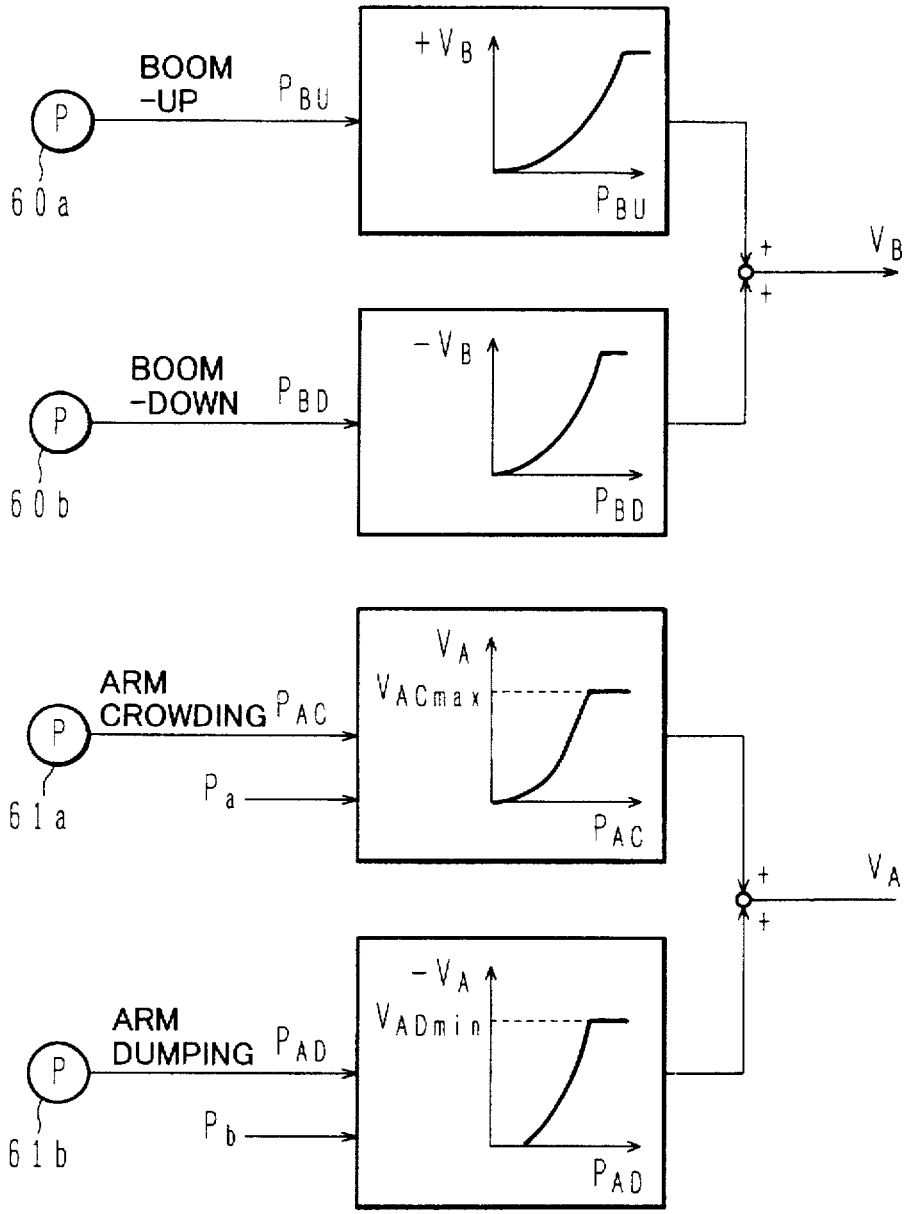
FIG. 20 is a diagram showing the relationships between pilot pressures and delivery rates of flow control valves.

Next, in step 162, supply flow rates through the flow control valve 5*b* for the arm corresponding to the modified pilot pressures Pa1, Pb1 are determined and, from the determined supply flow rates, speeds VAC1, VAD1 of the arm cylinder 3*b* are calculated. The memory of the control unit 9 also stores the relationships between pilot pressures PBU, PBD, PAC, PAD and supply flow rates VB, VA through the flow control valves 5*a*, 5*b* as shown in FIG. 20. By using those stored relationships, the control unit determines the supply flow rates through the flow control valve 5*b* and calculate the arm cylinder speeds VAC1, VAD1 in step 162. It is to be noted that the cylinder speeds may be directly determined from the pilot pressures by calculating relationships between the pilot pressures and the cylinder speeds beforehand, and storing the calculated relationships in the memory of the control unit 9.

Subsequently, in step 163, a maximum value VACmax of the crowding-side cylinder speed of the arm cylinder 3*b* and a minimum value VADmin (maximum value of an absolute value) of the dumping-side cylinder speed thereof are determined from the relationships shown in FIG. 20. The maximum value VACmax and the minimum value VADmin are then multiplied by the slowdown coefficient hg to produce a modified maximum value VAC2 and a modified minimum value VAD2 of the respective cylinder speeds.

Next, in step 164, a minimum value between VAC1 and VAC2 is set to a crowding-side target cylinder speed VAC of the arm cylinder 3*b*, and a maximum value between VAD1 and VAD2 (minimum value between absolute values of VAD1 and VAD2) is set to a dumping-side target cylinder speed VAD of the arm cylinder 3*b*. Thus, in the case of VAC1>VAC2 and VAD1<VAD2, VAC2 and VAD2 are selected, whereby the maximum value and the minimum value of the target cylinder speeds VAC, VAD are limited respectively to the modified maximum value VAC2 and the modified minimum value VAD2.

After that, in step 165, target pilot pressures Pa2, Pb2 in the pilot lines 45*a*, 45*b* are calculated from the target cylinder speeds VAC, VAD. This process is a reversal of the calculation of the arm cylinder speeds executed in step 162.

Then, from the target pilot pressures Pa2, Pb2 calculated in the step 165, command values of the proportional solenoid valves 11*a*, 11*b* necessary for producing those target pilot pressures are calculated in step 166.

On the other hand, if the distance D1 is larger than the distance Ya1 and it is determined in step 150 that the tip position of the bucket 1*c* is not in the slowdown area, or if the mode switch 20 is determined in step 152 as being turned off, the process flow goes to step 170 where a valve command values for maximizing an opening of the proportional solenoid valve 11*a*, 11*b* is output.

Here, carrying out the low-pass filter process on the pilot pressures Pa, Pb in step 161 means, as with the first embodiment, that the input original pilot pressures Pa, Pb having a step-like form are modified into the modified pilot pressures Pa1, Pb1 rising more slowly, as shown in FIG. 10, and results in that the lever operation is slowed down apparently. Also, increasing the time constant tg for use in the low-pass filter process as the distance D1 decreases means that the modified pilot pressures Pa1, Pb1 are forced to rise more slowly as the tip of the bucket 1*c* comes closer to the boundary of the excavation area. Thus, an amount of reduction in magnitude of the pilot pressures Pa, Pb is gradually increased as the tip of the bucket 1*c* comes closer to the boundary of the excavation area.

Further, multiplying the maximum value VACmax and the minimum value VADmin of the cylinder speeds by the slowdown coefficient hg to produce the modified maximum value VAC2 and the modified minimum value VAD2 of the cylinder speeds in step 163 means that because hg takes a smaller value as the distance D1 decreases, the modified maximum value VAC2 and an absolute value of the modified minimum value VAD2 are reduced as the tip of the bucket 1*c* comes closer to the boundary of the excavation area. In addition, hg is a sine function of the angle θg formed by the straight line connecting the tip of the bucket 1*c* and the pivot center of the arm 1*b* relative to the boundary of the excavation area, as stated above, and it takes a smaller value at the smaller angle θg. Therefore, as the front device 1A is extended to a farther position, the modified maximum value VAC2 and the absolute value of the modified minimum value VAD2 are reduced. Accordingly, when VAC2, VAD2 are selected as the target cylinder speeds VAC, VAD in step 164, the target pilot pressures Pa2, Pb2 are reduced in a larger amount as the tip of the bucket 1*c* comes closer to the boundary of the excavation area and the front device 1A is further extended.

The target cylinder speed calculating portion 9*c* receives values of the pilot pressures detected by the pressure sensors 60*a*, 60*b*, 61*c*, 61*d*, determines supply flow rates through the flow control valves 5*a*, 5*b* from the above-mentioned relationships shown in FIG. 20, and calculates target speeds of the boom cylinder 3*a* and the arm cylinder 3*b* from the determined supply flow rates.

The target tip speed vector calculating portion 9*d* determines a target speed vector Vc at the tip of the bucket 1*c* from the tip position of the bucket determined by the front posture calculating portion 9*b*, the target cylinder speed determined by the target cylinder speed calculating portion 9*c*, and the various dimensions, such as L1, L2 and L3, stored in the memory of the control unit 9. At this time, the target speed vector Vc is first determined as values on the XY-coordinate system shown in FIG. 3, and then determined as values on the XaYa-coordinate system by transforming the values on the XY-coordinate system into the values on the XaYa-coordinate system using the transform data from the XY-coordinate system to the XaYa-coordinate system previously determined by the area setting calculating portion 9*a*. Here, an Xa-coordinate value Vcx of the target speed vector Vc on the XaYa-coordinate system represents a vector component in the direction parallel to the boundary of the set area, and a Ya-coordinate value Vcy thereof represents a vector component in the direction vertical to the boundary of the set area.

When the tip of the bucket 1*c* is positioned within the set area near the boundary thereof and the target speed vector Vc has a component in the direction toward the boundary of the set area, the direction change control portion 9e modifies the vertical vector component such that it is gradually reduced as the bucket tip comes closer to the boundary of the set area. In other words, a vector (reversed vector) being smaller than the vector component Vcy in the vertical direction and orienting away from the set area is added to the vector component Vcy.

Figure 21:
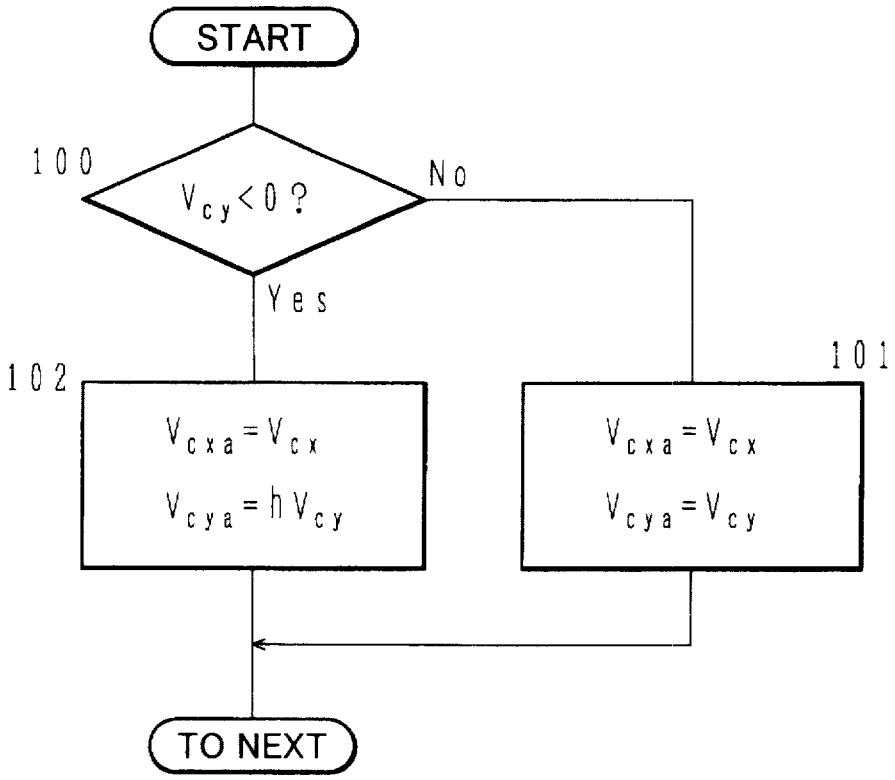
FIG. 21 is a flowchart showing processing steps executed in a direction change control portion.

FIG. 21 is a flowchart showing control steps executed in the direction change control portion 9e. First, in step 100, it is determined whether the component of the target speed vector Vc vertical to the boundary of the set area, i.e., the Ya-coordinate value Vcy on the XaYa-coordinate system, is positive or negative. If the Ya-coordinate value Vcy is positive, this means that the bucket tip has a speed vector directing away from the boundary of the set area. Therefore, the process flow goes to step 101 where the Xa-coordinate value Vcx and the Ya-coordinate value Vcy of the target speed vector Vc are set, as they are, to vector components Vcxa, Vcya after modification. If the Ya-coordinate value Vcy is negative, this means that the bucket tip has a speed vector directing toward the boundary of the set area. Therefore, the process flow goes to step 102 where, for the direction change control, the Xa-coordinate value Vcx of the target speed vector Vc is set, as it is, to the vector component Vcxa after modification, while a value obtained by multiplying the Ya-coordinate value Vcy by a coefficient h is set to the vector component Vcya after modification.

Figure 22:
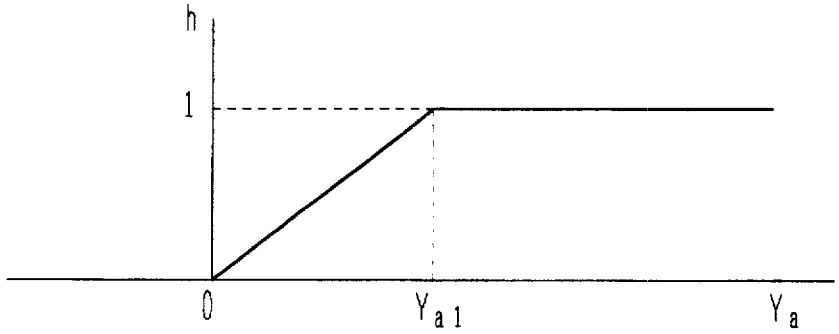
FIG. 22 is a graph showing the relationship between the distance Ya from the bucket tip to the boundary of the set area and a coefficient h in the direction change control portion.

Here, as shown in FIG. 22, the coefficient h is a value which takes 1 when the distance Ya between the tip of the bucket 1c and the boundary of the set area is larger than a preset value Ya1, which is gradually reduced from 1 as the distance Ya decreases when the distance Ya is smaller than the preset value Ya1, and which takes 0 when the distance Ya becomes 0, i.e., when the bucket tip reaches the boundary of the set area. Such a relationship between h and Ya is stored in the memory of the control unit 9.

In the direction change control portion 9e, the tip position of the bucket 1c determined by the front posture calculating portion 9b is transformed into values on the XaYa-coordinate system by using the transform data from the XY-coordinate system to the XaYa-coordinate system previously determined by the area setting calculating portion 9a. Then, the distance Ya between the tip of the bucket 1c and the boundary of the set area is determined from the Ya-coordinate value, and the coefficient h is determined from the distance Ya based on the relationship of FIG. 22.

By modifying the vertical vector component Vcy of the target speed vector Vc as described above, the vertical vector component Vcy is reduced such that an amount of reduction in the vertical vector component Vcy is increased as the distance Ya decreases. Thus, the target speed vector Vc is modified into a target speed vector Vca.

A path along which the tip of the bucket 1c is moved when the direction change control is performed as per the above-described target speed vector Vca after modification is the same as in the first embodiment described above with reference to FIG. 12.

Figure 23:
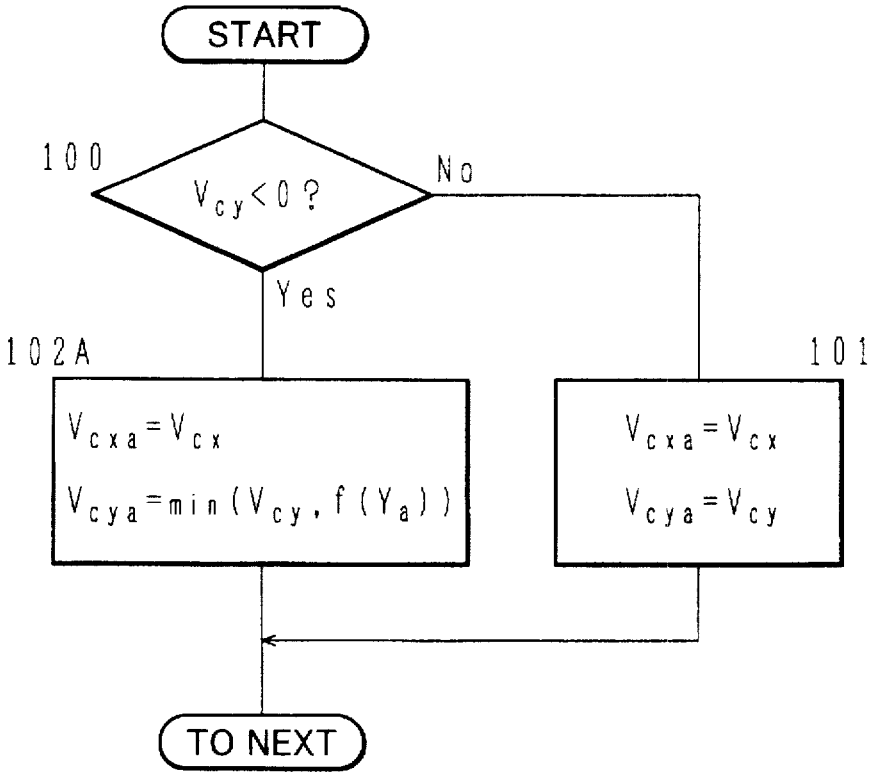
FIG. 23 is a flowchart showing other processing steps executed in the direction change control portion.
Figure 24:
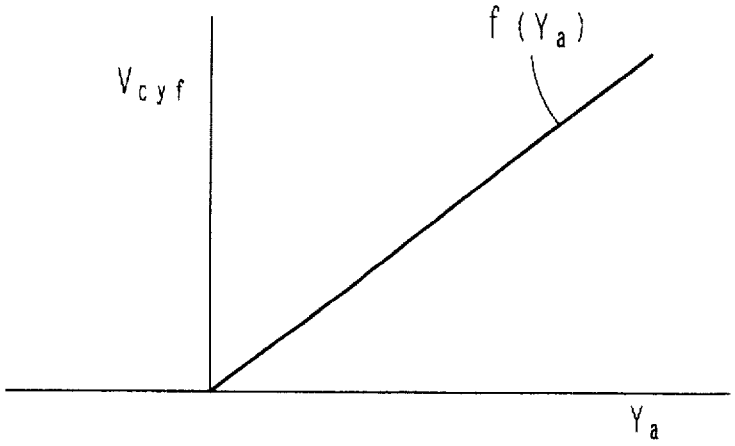
FIG. 24 is a graph showing the relationship between the distance Fa and a function Vcyf=f(Ya).

FIG. 23 is a flowchart showing another example of control procedures executed in the direction change control portion 9e. In this example, if the component Vcy of the target speed vector Vc vertical to the boundary of the set area (i.e., the Ya-coordinate value of the target speed vector Vc) is determined to be negative in step 100, the process flow goes to step 102A where a reduced Ya-coordinate value Vcyf corresponding to the distance Ya between the tip of the bucket 1c and the boundary of the set area is determined from the functional relationship of Vcyf=f(Ya), shown in FIG. 24, stored in the memory of the control unit 9 and smaller one of the Ya-coordinate values Vcyf and Vcy is then set to the vector component Vcya after modification. This provides an advantage that when the tip of the bucket 1c is slowly moved, the bucket speed is not reduced any more even if the bucket tip comes closer to the boundary of the set area, enabling the operation to be carried out as per manipulation by the operator.

In spite of that the vertical component of the target speed vector at the bucket tip is reduced as explained above, it is very difficult to make the vertical vector component nil (0) at the vertical distance Ya=0 due to variations caused by manufacture tolerances of the flow control valves and other hydraulic equipment, causing the bucket tip to often go out of the set area. In this embodiment, however, since the lever signal slowdown control is performed as described above and restoration control described later is also effected, the bucket tip is controlled to operate almost on the boundary of the set area. Because of the lever signal slowdown control and the restoration control being thus effected in a combined manner, the relationships shown in FIGS. 22 and 24 may be set such that the coefficient h or the Ya-coordinate value Vchf after reduction is somewhat above nil (0) at the vertical distance Ya=0.

While the horizontal component (Xa-coordinate value) of the target speed vector remains the same in the above-explained control, it is not always required to make the horizontal component remain the same. The horizontal component may be increased to speed up the bucket tip, or decreased to slow down the bucket tip.

The post-modification target cylinder speed calculating portion 9f calculates a target cylinder speed of the boom cylinder 3a from the target speed vector after modification determined by the direction change control portion 9e. This process is a reversal of the calculation executed in the target tip speed vector calculating portion 9d.

Here, in the case of crowding the arm with intent to perform excavation work toward the body (i.e., the arm crowding operation), since the vertical component Vcy of the target speed vector Vc can be reduced by raising the boom 1a, the calculating portion 9f calculates a target cylinder speed for moving the boom 1a upward. Also, in the case of operating the bucket tip in the direction to push it by the combined operation of boom-down and arm dumping (i.e., the arm-dumping combined operation), a target vector in the direction going out of the set area is provided when the arm dumping operation is performed from a position near the body (nearby position). In this case, since the vertical component Vcy of the target speed vector Vc can be reduced by switching the boom operation from boom-down to boom-up, the calculating portion 9f calculates a target cylinder speed for switching the boom operation from boom-down to boom-up.

In the restoration control portion 9g, when the tip of the bucket 1c goes out of the set area, the target speed vector is modified depending on the distance from the boundary of the set area so that the bucket tip is returned to the set area. In other words, a vector (reversed vector) being larger than the vector component Vay in the vertical direction and orienting toward the set area is added to the vector component Vcy.

Figure 25:
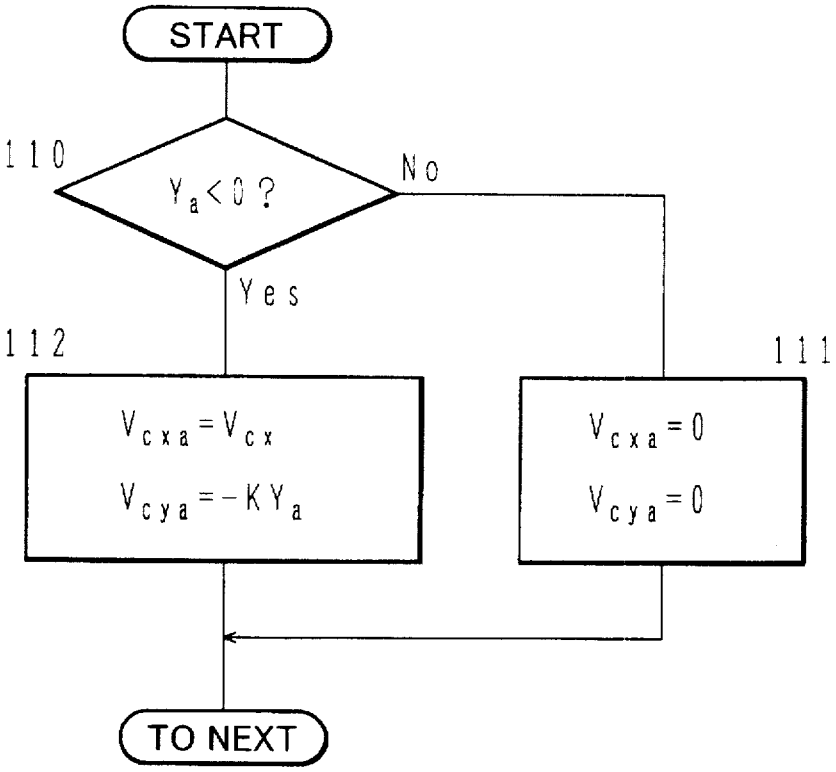
FIG. 25 is a flowchart showing processing steps executed in a restoration control portion.

FIG. 25 is a flowchart showing control steps executed in the restoration control portion 9g. First, in step 110, it is determined whether the distance Ya between the tip of the bucket 1c and the boundary of the set area is positive or negative. Here, the distance Ya is determined by transforming the position of the front tip determined by the front posture calculating portion 9b into values on the XaYa-coordinate system by using the transform data from the XY-coordinate system to the XaYa-coordinate system, and then extracting the converted Ya-coordinate value, as described above. If the distance Ya is positive, this means that the bucket tip is still within the set area. Therefore, the process flow goes to step 111 where the Xa-coordinate value Vcx and the Ya-coordinate value Vcy of the target speed vector Vc are each set to 0 to carry out the direction change control explained above with priority. If the distance Ya is negative, this means that the bucket tip has moved out of the boundary of the set area. Therefore, the process flow goes to step 112 where, for the restoration control, the Xa-coordinate value Vcx of the target speed vector Vc is set, as it is, to the vector component Vcxa after modification, while a value obtained by multiplying the distance Ya between the bucket tip and the boundary of the set area by a coefficient—K is set to the vector component Vcya after modification. Here, the coefficient K is an arbitrary value determined from the viewpoint of control characteristics, and—eKVcy represents a speed vector in the reversed direction which becomes smaller as the distance Ya decreases. Incidentally, K may be a function of which value is gradually reduced as the distance Ya decreases. In this case,—KVcy is reduced at a greater rate as the distance Ya decreases.

By modifying the vertical vector component Vcy of the target speed vector Vc as described above, the target speed vector Vc is modified into a target speed vector Vca so that the vertical vector component Vcy is reduced as the distance Ya decreases.

A path along which the tip of the bucket 1c is moved when the restoration control is performed as per the above-described target speed vector Vca after modification is the same as in the first embodiment described above with reference to FIG. 14. Thus, since the tip of the bucket 1c is controlled to return to the set area by the restoration control portion 9g, a restoration area is defined outside the set area.

The post-modification target boom cylinder speed calculating portion 9h calculates a target cylinder speed of the boom cylinder 3a from the target speed vector after modification determined by the restoration control portion 9g. This process is a reversal of the calculation executed in the target tip speed vector calculating portion 9d. In the restoration control, the calculating portion 9h calculates a target cylinder speed for moving the boom 1a upward so that the bucket tip is returned to the set area with an ascent of the boom 1a.

The target cylinder speed selector 9i selects larger one (maximum value) of a value of the target cylinder speed determined by the target boom cylinder speed calculating portion 9f for the direction change control and a value of the target cylinder speed determined by the target boom cylinder speed calculating portion 9h for the restoration control, and then sets the selected value as a target boom cylinder speed to be output.

Here, when the distance Ya between the bucket tip and the boundary of the set area is positive, the target speed vector components are both set to 0 in step 111 of FIG. 25 and the target speed vector components set in step 101 or 102 of FIG. 21 always have greater values. Accordingly, the target boom cylinder speed determined by the target cylinder boom speed calculating portion 9f for the direction change control is selected. When the distance Ya is negative and the vertical component Vcy of the target speed vector is negative, the vertical component Vcya after modification is set to 0 in step 102 of FIG. 21 because of h=0 and the vertical component set in step 112 of FIG. 25 always has a greater value. Accordingly, the target boom cylinder speed determined by the target boom cylinder speed calculating portion 9h for the restoration control is selected. When the distance Ya is negative and the vertical component Vcy of the target speed vector is positive, the target cylinder speed determined by the target boom cylinder speed calculating portion 9f or 9h is selected depending on which one of the vertical component Vcy of the target speed vector Vc set in step 101 of FIG. 21 and the vertical component KYa in step 112 of FIG. 25 has a larger value. Incidentally, as an alternative, the selector 9i may be arranged to take the sum of both the components, for example, rather than selecting the maximum value.

The target pilot pressure calculating portion 9j calculates target pilot pressures in the pilot lines 44a, 44b from the target cylinder speed to be output which are selected by the target cylinder speed selector 9i. This process is a reversal of the calculation executed in the target cylinder speed calculating portion 9c.

The valve command calculating portion 9k calculates, from the target pilot pressures calculated by the target pilot pressure calculating portion 9j, command values for the proportional solenoid valves 10a, 10b necessary to develop those target pilot pressures. The command values are amplified by amplifiers and output as electric signals to the proportional solenoid valves 10a, 10b.

When the direction change control (slowdown control) is carried out, boom-up is effected in the case of the arm crowding operation, as explained above, and the boom-up is made by outputting an electric signal to the proportional solenoid valve 10a associated with the pilot line 44a on the boom-up side. In the case of the arm-dumping combined operation with the arm positioned nearer to the body than its vertical state relative to the ground surface, the boom operation is switched from boom-down to boom-up to slow down the arm dumping motion. This switching from boom-down to boom-up is effected by making nil the electric signal output to the proportional solenoid valve 10b disposed in the pilot line 44b on the boom-down side, and outputting an electric signal to the proportional solenoid valve 10a. In the restoration control, an electric signal is output to the proportional solenoid valve 10a associated with the pilot line 44a on the boom-up side. In other cases, an electric signal corresponding to the pilot pressure from the control lever unit 4a is output to the proportional solenoid valve 10b so that the pilot pressure is delivered as it is.

In the above arrangement, supposing that the arm 1b is a first particular front member and the boom 1a is a second particular front member, the lever signal slowdown control portion 9m and the proportional solenoid valves 11a, 11b constitute first signal modifying means for modifying, based on the values calculated by the front posture calculating portion 9b as first calculating means, at least the operation signal Pa or Pb from the control lever unit 4b associated with the first particular front member 1b among the plurality of lever control units 4a–4f so as to reduce the operating signal Pa or Pb, when the front device 1A is near the boundary of the set area therewithin. The target cylinder speed calculating portion 9c, the target tip speed vector calculating portion 9d, the direction change control portion 9e, the post-modification target cylinder speed calculating portion 9f, the target cylinder speed selector 9i, the target pilot pressure calculating portion 9j, the valve command calculating portion 9k, the proportional solenoid valves 10a, 10b, and the shuttle valve 12 constitute second signal modifying means for calculating, based on at least the operation signals Pa2 or Pb2 reduced by the first signal modifying means 260 (Pa2 or Pb2 and the operation signal from the control lever unit 4a in this embodiment) and the values calculated by the first calculating means, a speed Vc for control of the front device 1A, and modifying, based on the speed Vc for control, at least the operation signal from the control lever unit 4a associated with the second particular front member 1a among the plurality of lever control units 4a–4f (the operation signals of the control lever units 4a, 4b in this embodiment), such that the moving speed of the front device in the direction toward the boundary of the set area is reduced within the set area.

Also, the mode switch 20 and the step 152 in FIG. 19 constitute mode selecting means for selecting whether or not the operation signal Pa or Pb from the control lever unit 4b is modified to be reduced by the first signal modifying means. When the mode selecting means 20, 152 is operated to select no modification by the first signal modifying means, the first signal modifying means 9m, 11a, 11b does not modify the operation signal Pa or Pb and the second signal modifying means 9c, 9d, 9e, etc. calculates, based on at least the operation signal Pa or Pb not modified (Pa or Pb and the operation signal of the control lever unit 4a in this embodiment) and the values calculated by the first calculating means 9b, the speed Vc for control of the front device 1A, and modifies, based on the speed Vc for control, at least the operation signal from the control lever unit 4a associated with the second particular front member 1a (the operation signals of the control lever units 4a, 4b in this embodiment).

The operation of this embodiment having the above-explained arrangement will be described below. The following description will be made on the same work examples as stated above, i.e., the case of crowding the arm with the intention of digging the ground toward the body (i.e., the arm crowding operation) and the case of operating the bucket tip in the direction to push it by the combined operation of boom-down and arm dumping (i.e., the arm-dumping combined operation).

When the arm is crowded with the intention of digging the ground toward the body, the tip of the bucket 1c gradually comes closer to the boundary of the set area. If the distance between the bucket tip and the boundary of the set area becomes smaller than Ya1, the direction change control portion 9e makes modification to reduce the vector component of the target speed vector Vc at the bucket tip in the direction toward the boundary of the set area (i.e., the vector component vertical to the boundary), thereby carrying out the direction change control (slowdown control) for the bucket tip. More specifically, the post-modification target boom cylinder speed calculating portions 9f calculates a cylinder speed in the direction of extending the boom cylinder 3a, the target pilot pressure calculating portion 9j calculates a target pilot pressure in the pilot line 44a on the boom-up side, and the valve command calculating portion 9k outputs an electric signal to the proportional solenoid valve 10a. Therefore, the proportional solenoid valve 10a outputs a control pressure corresponding to the target pilot pressure calculated by the calculating portion 9j, and the control pressure is selected by the shuttle valve 12 and introduced to the boom-up side hydraulic driving sector 50a of the flow control valve 5a for the boom. With such an operation of the proportional solenoid valve 10a, the movement of the bucket tip in the direction vertical to the boundary of the set area is controlled to slow down, while the speed component in the direction along the boundary of the set area is not reduced. Accordingly, the tip of the bucket 1c can be moved along the boundary of the set area as shown in FIG. 12. It is thus possible to efficiently perform excavation while limiting an area where the tip of the bucket 1c is movable.

Even with the tip of the bucket 1c subjected to the slowdown control as described above when it is within and near the boundary of the set area, if the movement of the front device 1A is too quick, or if the control lever unit 4b is abruptly manipulated, the tip of the bucket 1c may go out of the set area to some extent due to a response delay in the control process and the inertia of the front device 1A. On that occasion, in this embodiment, by turning on the mode switch 20 to select the accuracy precedence work mode, the pilot pressures applied to the hydraulic driving sectors 51a, 51b of the flow control valve 5b for the arm are themselves reduced in the lever signal slowdown control portion 9m. Therefore, even if the moving speed of the front device 1A is extremely large, the overly quick movement of the front device 1A is suppressed as the tip of the bucket 1c approaches the boundary of the set area. Furthermore, even if the control lever unit 4b is abruptly manipulated, the arm actuator 3b is allowed to not only start moving smoothly, but also take a slower speed once started to move. This abates the effect of a delay in the hydraulic circuit and the effect of inertia. It is thus possible to reduce an amount by which the front device 1A projects out of the set area during the slowdown control, and to precisely move the front device 1A along the boundary of the set area.

Also, by turning off the mode switch 20 to select the speed precedence work mode, the valve command value for maximizing an opening of the proportional solenoid valve 11a, 11b is output from the lever signal slowdown control portion 9m and the pilot pressure from the control lever unit 4b is applied, as it is, to the hydraulic driving sector 51a, 51b of the flow control valve 5b for the arm. Therefore, the front device 1A can be moved depending on the magnitude of the pilot pressure without dropping the working efficiency.

In the case of operating the bucket tip in the direction to push it by the combined operation of boom-down and arm dumping, a target vector in the direction going out of the set area is provided when the arm dumping operation is performed from a position near the body (nearby position). Also, in this case, if the distance between the bucket tip and the boundary of the set area becomes smaller than Ya1, the direction change control portion 9e makes modification of the target speed vector Vc for the direction change control (slowdown control) of the bucket tip. More specifically, the post-modification target boom cylinder speed calculating portions 9f calculates a cylinder speed in the direction of extending the boom cylinder 3a, the target pilot pressure calculating portion 9j calculates a target pilot pressure in the pilot line 44a on the boom-up side while making nil a target pilot pressure in the pilot line 44b on the boom-down side, and the valve command calculating portion 9k outputs an electric signal to the proportional solenoid valve 10a while turning off an output to the proportional solenoid valve 10b. Therefore, the proportional solenoid valve 10b reduces the pilot pressure in the pilot line 44b down to nil (0) and the proportional solenoid valve 10a outputs a control pressure corresponding to the target pilot pressure to be produced as the pilot pressure in the pilot line 44a. With such operations of the proportional solenoid valves 10a, 10b, the direction change control is performed in the same manner as in the above case of the arm crowding operation. Accordingly, the tip of the bucket 1c can be moved fast along the boundary of the set area and it is thus possible to efficiently perform excavation while limiting an area where the tip of the bucket 1c is movable.

If the accuracy precedence work mode is selected by turning on the mode switch 20, the pilot pressures applied to the hydraulic driving sectors 51*a*, 51*b* of the flow control valve 5*b* for the arm are themselves reduced in the lever signal slowdown control portion 9*m*. Therefore, if the control lever unit 4*b* is abruptly manipulated, the arm actuator 3*b* is allowed to not only start moving smoothly, but also take a slower speed once started to move. This abates the effect of a delay in the hydraulic circuit and the effect of inertia. It is thus possible to reduce an amount by which the front device 1A projects out of the set area during the slowdown control, and to precisely move the front device 1A along the boundary of the set area.

Also, by turning off the mode switch 20 to select the speed precedence work mode, the valve command value for maximizing an opening of the proportional solenoid valve 11*a*, 11*b* is output from the lever signal slowdown control portion 9*m* and the pilot pressure from the control lever unit 4*b* is applied, as it is, to the hydraulic driving sector 51*a*, 51*b* of the flow control valve 5*b* for the arm. Therefore, the front device 1A can be moved depending on the magnitude of the pilot pressure without dropping the working efficiency.

As described above, in hydraulic excavators equipped with an operating system having control lever units of hydraulic pilot type, this embodiment can also provide similar advantages as in the first embodiment.

A third embodiment of the present invention will be described with reference to FIGS. 26 to 31. In these figures, equivalent members to those in FIGS. 1 and 15 are denoted by the same reference numerals.

Figure 26:
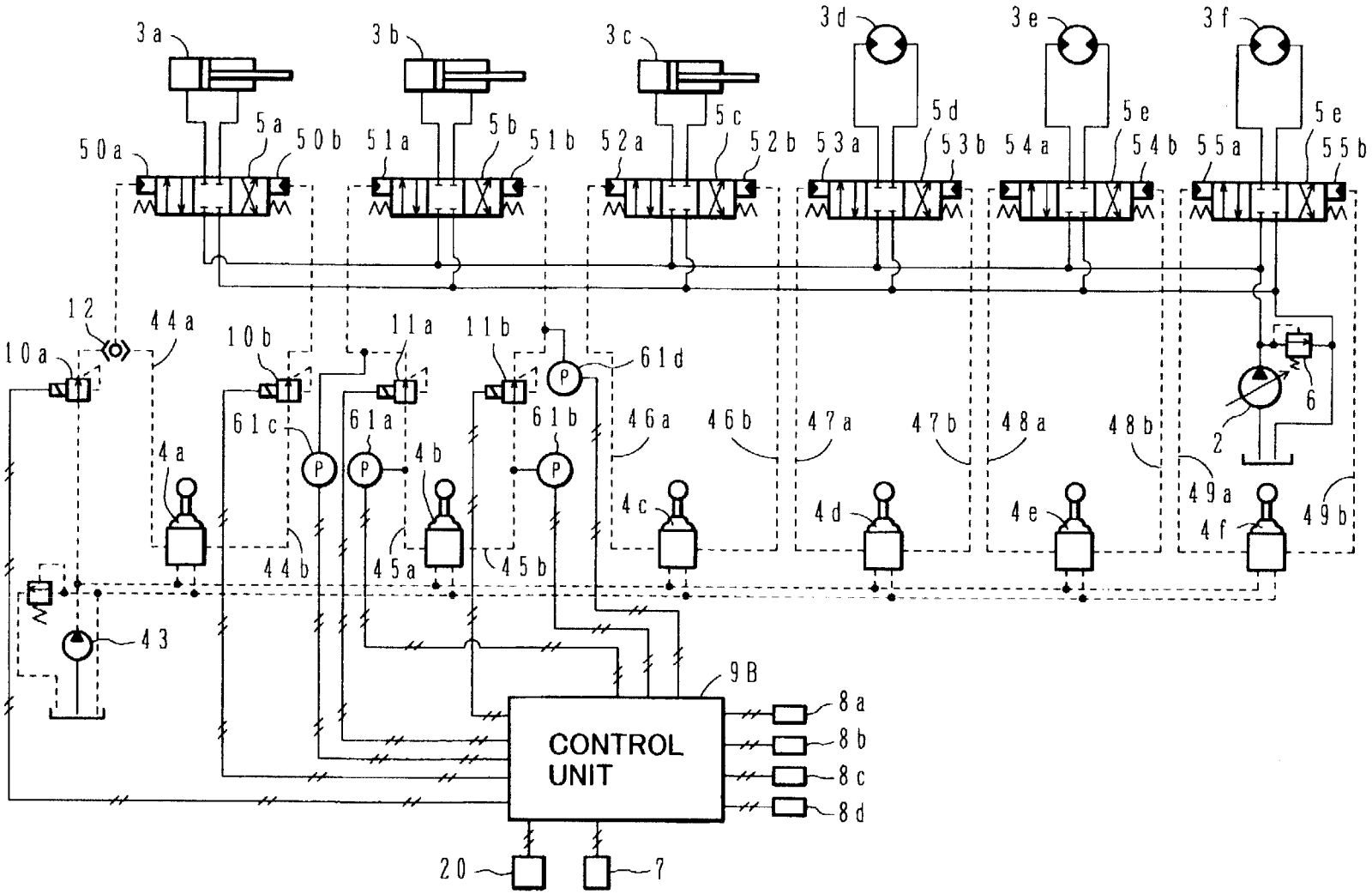
FIG. 26 is a diagram showing an area limiting excavation control system for construction machines according to a third embodiment of the present invention, along with a hydraulic drive system thereof.

Referring to FIG. 26, a hydraulic drive system equipped on a hydraulic excavator in which this embodiment is realized is the same as shown in FIG. 15. An area limiting excavation control system of this embodiment which is incorporated in such a hydraulic drive system is the same as shown in FIG. 15 except that the pressure sensors 60*a*, 60*b* shown in FIG. 15 are not provided and a control unit 9B has control functions described below.

Figure 27:
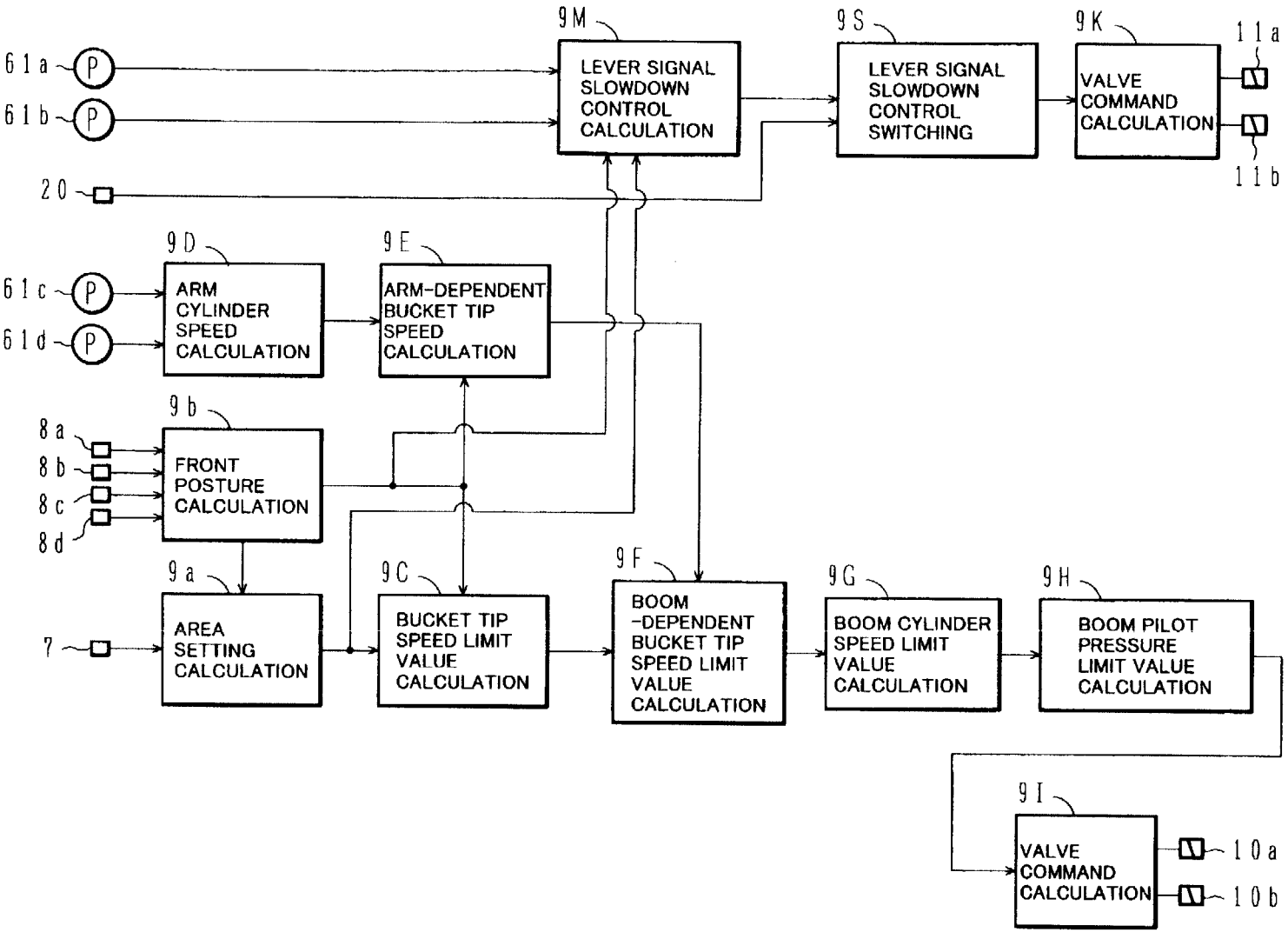
FIG. 27 is a functional block diagram showing control functions of a control unit.

Control functions of the control unit 9B are shown in FIG. 27. The control unit 9B includes various functions executed by an area setting calculating portion 9*a*, a front posture calculating portion 9*b*, a bucket tip speed limit value calculating portion 9C, an arm cylinder speed calculating portion 9D, an arm-dependent bucket tip speed calculating portion 9E, a boom-dependent bucket tip speed limit value calculating portion 9F, a boom cylinder speed limit value calculating portion 9G, a boom pilot pressure limit value calculating portion 9H, a boom-associated valve command calculating portion 9I, a lever signal slowdown control calculating portion 9M, a lever signal slowdown control switching portion 9S, and an arm-associated valve command calculating portion 9K.

Processing functions of the area setting calculating portion 9*a* and the front attachment posture calculating portion 9*b* are the same as in the second embodiment shown in FIG. 7.

The bucket tip speed limit value calculating portion 9C calculates a limit value a of the component of the bucket tip speed vertical to a boundary L of the set area depending on a distance D from the bucket tip to the boundary L. This calculation is carried out by storing the relationship as shown in FIG. 28 in a memory of the control unit 9B beforehand and reading out the stored relationship.

Figure 28:
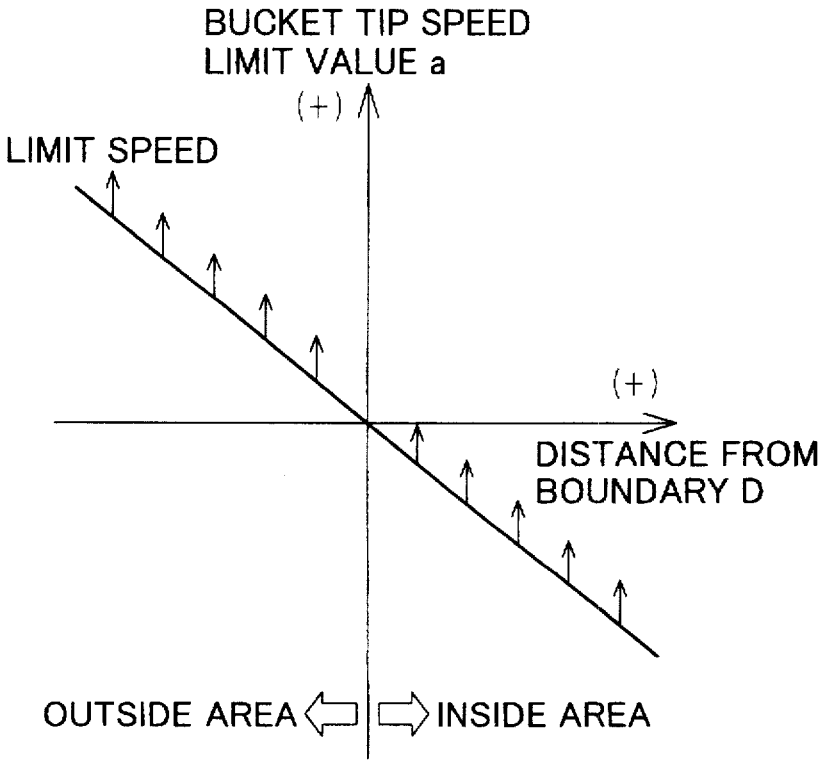
FIG. 28 is a graph showing the relationship between the distance from the bucket tip to the boundary of the set area and a bucket tip speed limit value used when the latter is determined.

In FIG. 28, the horizontal axis represents the distance D from the bucket tip to the boundary L, and the vertical Ad axis represents the limit value a of the component of the bucket tip speed vertical to the boundary L. As with the XaYa-coordinate system, the distance D on the horizontal axis and the speed limit value a on the vertical axis are each defined to be positive (+) in the direction toward the inside of the set area from the outside of the set area.

The relationship between the distance D and the limit value a is set such that when the bucket tip is inside the set area, a speed in the negative (−) direction proportional to the distance D is given as the limit value a of the component of the bucket tip speed vertical to the boundary L, and when the bucket tip is outside the set area, a speed in the positive (+) direction proportional to the distance D is given as the limit value a of the component of the bucket tip speed vertical to the boundary L. Accordingly, inside the set area, the bucket tip is slowed down only when the component of the bucket tip speed vertical to the boundary L exceeds the limit value in the negative (−) direction, and outside the set area, the bucket tip is sped up in the positive (+) direction.

The arm cylinder speed calculating portion 9D estimates an arm cylinder speed for control based on the command values (pilot pressures), which are detected by the pressure sensors 61*c*, 61*d*, applied to the flow control valve 5*b* for the arm nd the flow rate characteristics of the flow control valve 5*b*.

The arm-dependent bucket tip speed calculating portion 9E calculates an arm-dependent bucket tip speed (speed vector) b based on the arm cylinder speed and the position and posture of the front device 1A determined by the front posture calculating portion 9*b*.

The boom-dependent bucket tip speed limit value calculating portion 9F transforms the arm-dependent bucket tip speed b, which has been determined by the calculating portion 9E, from the XY-coordinate system to the XaYa-coordinate system by using the transform data determined by the area setting calculating portion 9*b*, calculates arm-dependent bucket tip speeds ($b_x$, $b_y$), and then calculates a limit value c of the boom-dependent bucket tip speed vertical to the boundary L based on the limit value a of the component of the bucket tip speed vertical to the boundary L determined by the calculating portion 9C and the component by of the arm-dependent bucket tip speed vertical to the boundary L. That process will now be described with reference to FIG. 29.

Figure 29:
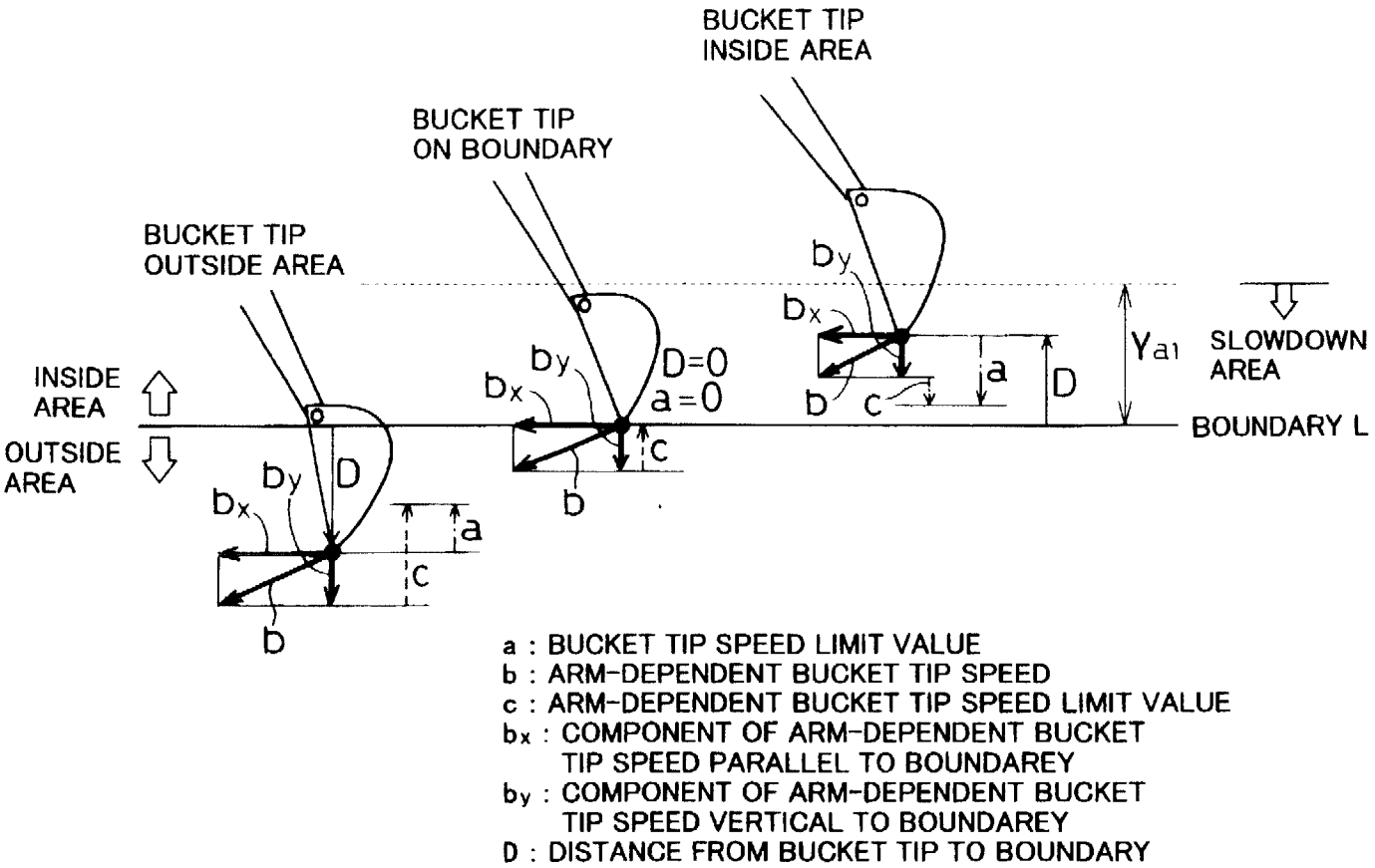
FIG. 29 is an illustration showing differences in operation of modifying a bucket tip speed by a boom among when the bucket tip is inside the set area, when it is on the boundary of the set area, and when it is outside the set area.

In FIG. 29, the difference ($a-b_y$) between the limit value a of the component of the bucket tip speed vertical to the boundary L determined by the bucket tip speed limit value calculating portion 9C and the component $b_y$ of the arm-dependent bucket tip speed b vertical to the boundary L determined by the arm-dependent bucket tip speed calculating portion 9E provides a limit value c of the boom-dependent bucket tip speed vertical to the boundary L. Then, the boom-dependent bucket tip speed limit value calculating portion 9F calculates the limit value c from the formula of $c=a-b_y$.

The meaning of the limit value c will be described separately for the case where the bucket tip is inside the set area, the case where the bucket tip is on the boundary of the set area, and the case where the bucket tip is outside the set area.

When the bucket tip is inside the set area, the bucket tip speed is restricted to the limit value a of the component of the bucket tip speed vertical to the boundary L in proportion to the distance D from the bucket tip to the boundary L and, therefore, the component of the boom-dependent bucket tip speed vertical to the boundary L is restricted to c ($=a-b_y$). If the component of the bucket tip speed b vertical to the boundary L exceeds c, it is slowed down to c.

When the bucket tip is on the boundary L of the set area, the limit value a of the component of the bucket tip speed vertical to the boundary L is set to 0, and the arm-dependent bucket tip speed b toward the outside of the set area is canceled out through the compensating operation of boom-up at the speed c. Thus, the component $b_y$ of the bucket tip speed vertical to the boundary L becomes 0.

When the bucket tip is outside the set area, the component of the bucket tip speed vertical to the boundary L is restricted to the upward speed a in proportion to the distance D from the bucket tip to the boundary L. To this end, the compensating operation of boom-up at the speed c is always performed so that the bucket tip is restored to the inside of the set area.

The boom cylinder speed limit value calculating portion 9G calculates a boom cylinder speed limit value through the coordinate transformation using the aforesaid transform data based on the limit value c of the boom-dependent bucket tip speed vertical to the boundary L and the position and posture of the front device 1A.

The boom pilot pressure limit value calculating portion 9H determines, based on the flow rate characteristics of the flow control valve **5*a* for the boom, a boom pilot pressure limit value corresponding to the boom cylinder speed limit value determined by the calculating portion 9G**.

The boom-associated valve command calculating portion 9I receives the pilot pressure limit value from the calculating portion 9H. When the limit value is positive, the calculating portion 9I outputs a voltage corresponding to the limit value to the proportional solenoid valve **10*a* on the boom-up side, thereby restricting the pilot pressure for the hydraulic driving sector 50*a* of the flow control valve 5*a* to the limit value, and also outputs a nil (0) voltage to the proportional solenoid valve 10*b* on the boom-down side. When the limit value is negative, the calculating portion 91 outputs a voltage corresponding to the limit value to the proportional solenoid valve 10*b* on the boom-down side, thereby restricting the pilot pressure for the hydraulic driving sector 50*b* of the flow control valve 5*a* to the limit value, and also outputs a nil (0) voltage to the proportional solenoid valve 10*a*** on the boom-up side.

The lever signal slowdown control calculating portion 9M performs the lever signal slowdown process for reducing the operation signal (pilot pressure) from the control lever unit **4*b* for the arm of the front device 1A**.

Figure 30:
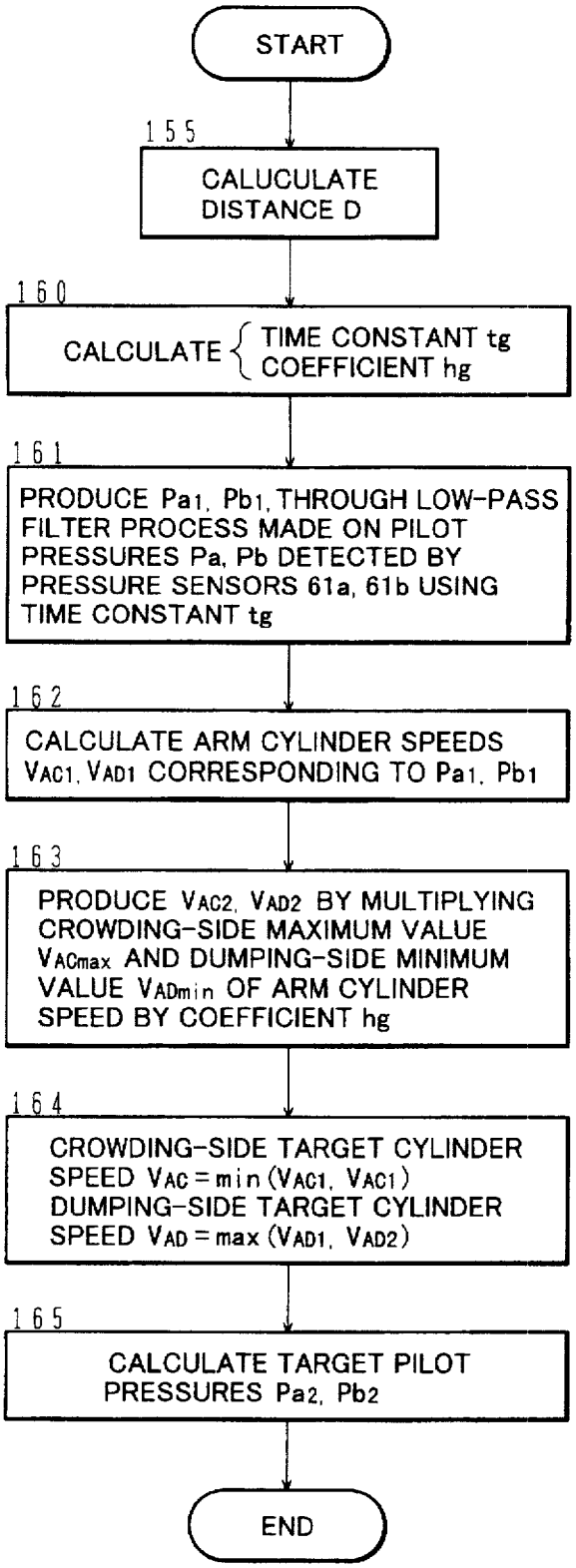
FIG. 30 is a flowchart showing processing steps executed in a lever signal slowdown control calculating portion.

FIG. 30 is a flowchart showing processing steps executed in the lever signal slowdown control calculating portion 9M. First, in step 155, the tip position of the bucket **1*c* determined by the front posture calculating portion 9*b* on the XY-coordinate system is transformed into values on the XaYa-coordinate system by using the transform data obtained in the area setting calculating portion 9*a*, and a distance D between the tip position of the bucket 1*c* within the set area and the boundary of the set area is determined from the Ya-coordinate value resulted for the bucket tip position. After that, by carrying out similar processing to steps 160–165 shown in FIG. 19, the target pilot pressures Pa2, Pb2 to be produced in the pilot lines 45*a*, 45*b*** for the lever signal slowdown control are calculated.

The lever signal slowdown control switching portion 9S selectively outputs the value calculated by the calculating portion 9M depending on whether or not the tip of the bucket **1*c* is in the slowdown area, or whether the mode switch 20 is turned on or off. Details of this switching process is shown in a flowchart of FIG. 31**.

Figure 31:
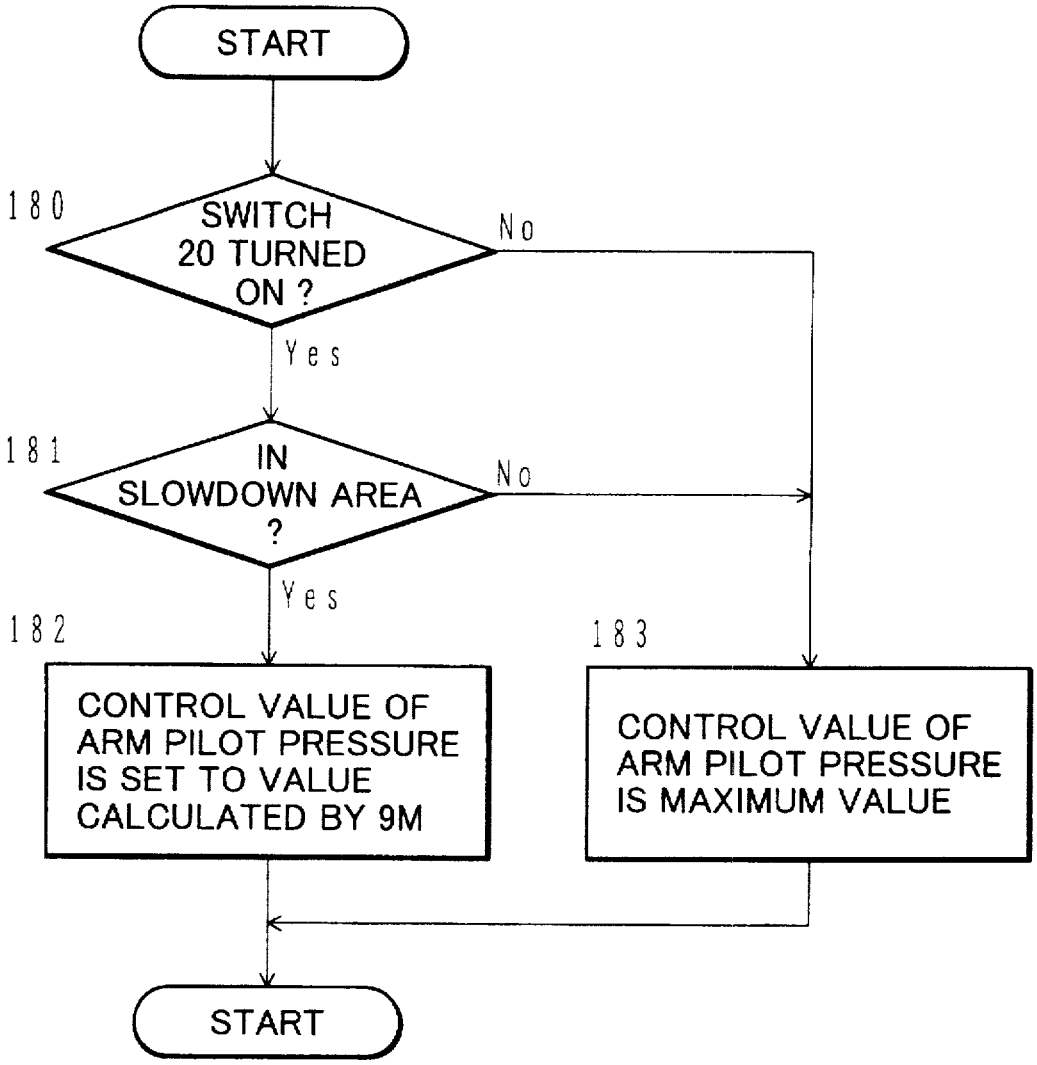
FIG. 31 is a flowchart showing processing steps executed in a lever signal slowdown control switching portion.

Referring to FIG. 31, in step 180, it is first determined whether or not the mode switch 20 is depressed (turned on). If depressed, the process flow goes to step 181. It is determined in step 181 whether or not the tip of the bucket **1*c* has entered the slowdown area. The memory of the control unit 9B stores, as a value for setting a range of the slowdown area, the distance Ya1 from the boundary of the set area as shown in FIG. 6. Specifically, in step 181, if the distance D determined by the lever signal slowdown control calculating portion 9M in step 155 is smaller than the distance Ya1, it is determined that the bucket tip has entered the slowdown area. If the bucket tip is determined in step 181 as having entered the slowdown area, the process flow goes to step 182 where the value calculated by the calculating portion 9M is output, as it is, as the limit value of the arm pilot pressure. If the distance D is a negative value, the target pilot pressure calculated at D=0 continues to be output as the limit value of the arm pilot pressure. On the other hand, if the mode switch 20 is not depressed (turned off) in step 180, or if the distance D is larger than the distance Ya1 and it is determined in step 181 that the bucket tip is not in the slowdown area, the process flow goes to step 183** where a maximum value is output as the limit value of the arm pilot pressure.

The arm-associated valve command calculating portion 9K receives the limit value of the arm pilot pressure from the switching portion 9S. When the limit value is positive, the calculating portion 9K outputs a voltage corresponding to the limit value to the proportional solenoid valve **11*a* on the arm-crowding side, thereby restricting the pilot pressure for the hydraulic driving sector 51*a* of the flow control valve 5*b* to the limit value, and also outputs a nil (0) voltage to the proportional solenoid valve 11*b* on the arm-dumping side. When the limit value is negative, the calculating portion 9K outputs a voltage corresponding to the limit value to the proportional solenoid valve 11*b* on the arm-dumping side, thereby restricting the pilot pressure for the hydraulic driving sector 51*b* of the flow control valve 5*b* to the limit value, and also outputs a nil (0) voltage to the proportional solenoid valve 11*a*** on the arm-crowding side.

In the above arrangement, supposing that the arm **1*b* is a first particular front member and the boom 1*a* is a second particular front member, the lever signal slowdown control calculating portion 9M and the proportional solenoid valves 11*a*, 11*b* constitute first signal modifying means for modifying, based on the values calculated by the front posture calculating portion 9*b* as first calculating means, at least the operation signal of the control lever unit 4*b* associated with the first particular front member 1*b* among the plurality of lever control units 4*a*–4*f* so as to reduce the operation signal, when the front device 1A is near the boundary of the set area therewithin. The bucket tip speed limit value calculating portion 9C, the arm cylinder speed calculating portion 9D, the arm-dependent bucket tip speed calculating portion 9E, the boom-dependent bucket tip speed limit value calculating portion 9F, the boom cylinder speed limit value calculating portion 9G, the boom pilot pressure limit value calculating portion 9H, the boom-associated valve command calculating portion 9I, the proportional solenoid valve 10*a*, and the shuttle valve 12 constitute second signal modifying means for calculating, based on at least the operation signal reduced by the first signal modifying means and the values calculated by the first calculating means, a speed b for control of the front device 1A, and modifying, based on the speed b for control, at least the operation signal from the control lever unit 4*a* associated with the second particular front member 1*a* among the plurality of lever control units 4*a*–4*f***, such that the moving speed of the front device in the direction toward the boundary of the set area is reduced within the set area.

Also, the mode switch 20 and the lever signal slowdown control switching portion 9S constitute mode selecting means for selecting whether or not the operation signal from the control lever unit 4b is modified to be reduced by the first signal modifying means. When the mode selecting means 20, 9S is operated to select no modification by the first signal modifying means, the first signal modifying means 9M, 11a, 11b does not modify the operation signal and the second signal modifying means 9c, 9d, 9e, etc. calculates, based on at least the operation signal not modified and the values calculated by the first calculating means 9b, the speed b for control of the front device 1A, and modifies, based on the speed b for control, at least the operation signal from the control lever unit 4a associated with the second particular front member 1a.

The operation of this embodiment having the above-explained arrangement will be described below. The following description will be made on several work examples; i.e., the case of operating the boom control lever unit 4a in the boom-down direction to lower the boom with the intention of positioning the bucket tip (i.e., the boom-down operation), and the case of operating the arm control lever unit 4b in the arm-crowding direction to crowd the arm with the intention of digging the ground toward the body (i.e., the arm crowding operation).

When the control lever of the boom control lever unit 4a is operated in the boom-down direction with the intention of positioning the bucket tip, a pilot pressure representing the command value from the control lever unit 4a is applied to the hydraulic driving sector 50b of the flow control value 5a on the boom-down side through the pilot line 44b. At the same time, the calculating portion 9C calculates, based on the relationship shown in FIG. 28, a limit value a (<0) of the bucket tip speed in proportion to the distance D from the bucket tip to the boundary L of the set area, the calculating portion 9F calculates a limit value c=a (<0) of the boom-dependent bucket tip speed, and the boom pilot pressure limit value calculating portion 9H calculates a negative boom command limit value corresponding to the limit value c, and the valve command calculating portion 9I outputs a voltage corresponding to the limit value to the proportional solenoid valve 10b, thereby restricting the pilot pressure for the hydraulic driving sector 50b of the flow control valve 5a on the boom-down side, and also outputs a nil (0) voltage to the proportional solenoid valve 10a for making nil the pilot pressure for the hydraulic driving sector 50a of the flow control valve 5a on the boom-up side. Here, when the bucket tip is far away from the boundary L of the set area, the limit value of the boom pilot pressure obtained by the calculating portion 9H has an absolute value greater than the pilot pressure input from the control lever unit 4a and, therefore, the proportional solenoid valve 10b outputs the pilot pressure input from the control lever unit 4a as it is. Accordingly, the boom is gradually moved down depending on the pilot pressure input from the control lever unit 4a.

As the boom is gradually moved down and the bucket tip comes closer to the boundary L of the set area as mentioned above, the limit value c=a (<0) of the boom-dependent bucket tip speed calculated by the calculating portion 9F is increased (its absolute value |a| or |c| is reduced) and an absolute value of the corresponding boom command limit value (<0) calculated by the calculating portion 9H is reduced. Then, when the absolute value of the limit value becomes smaller than the command value from the control lever unit 4a and the voltage output to the proportional solenoid valve 10b from the valve command calculating portion 9I is reduced correspondingly, the proportional solenoid valve 10b reduces and outputs the pilot pressure input from the control lever unit 4a for gradually restricting the pilot pressure applied to the driving sector 50b of the flow control valve 5a on the boom-down side depending on the limit value c. Thus, the boom-down speed is gradually restricted as the bucket tip approaches the boundary L of the set area, and the boom is stopped when the bucket tip reaches the boundary L of the set area. As a result, the bucket tip can be easily and smoothly positioned.

When the bucket tip goes out beyond the boundary L of the set area, the limit value a (=c) of the bucket tip speed in proportion to the distance D from the bucket tip to the boundary L of the set area is calculated as a positive value by the calculating portion 9C based on the relationship shown in FIG. 28, and the valve command calculating portion 9I outputs a voltage corresponding to the limit value c to the proportional solenoid valve 10a for applying a pilot pressure corresponding to the limit value a to the hydraulic driving sector 50a of the flow control valve 5a on the boom-up side. The boom is thereby moved in the boom-up direction at a speed proportional to the distance D for restoration toward the set area, and then stopped when the bucket tip is returned to the boundary L of the set area. As a result, the bucket tip can be more smoothly positioned.

Further, when the control lever of the arm control lever unit 4b is operated in the arm-crowding direction with the intention of digging the ground toward the body, a pilot pressure (described later) output from the proportional solenoid valve 11a is applied to the hydraulic driving sector 51a of the flow control valve 5b on the arm-crowding side, causing the arm to be moved down toward the body.

At the same time, the pilot pressure applied to the hydraulic driving sector 51a of the flow control valve 5b (i.e., the output pressure of the proportional solenoid valve 11a) is detected by the pressure sensor 61c and input to the calculating portion 9D which calculates an arm cylinder speed, and then the calculating portion 9E calculates an arm-dependent bucket tip speed b. Also, the calculating portion 9C calculates, based on the relationship shown in FIG. 28, a limit value a (<0) of the bucket tip speed in proportion to the distance D from the bucket tip to the boundary L of the set area, and the calculating portion 9F calculates a limit value $c=a-b_y$ of the boom-dependent bucket tip speed. Here, when the bucket tip is so far away from the boundary L of the set area as to meet the relationship of $a<b_y(|a|>|b_y|)$, the command value c is calculated as a negative value. Therefore, the valve command calculating portion 9I outputs a voltage corresponding to the limit value to the proportional solenoid valve 10b, thereby restricting the pilot pressure for the hydraulic driving sector 50b of the flow control value 5a on the boom-down side to the limit value, and also outputs a nil (0) voltage to the proportional solenoid valve 10a for making nil the pilot pressure for the hydraulic driving sector 50a of the flow control valve 5a on the boom-up side. At this time, since the control lever unit 4a is not operated, no pilot pressure is supplied to the hydraulic driving sector 50b of the flow control valve 5a. As a result, the arm is gradually moved toward the body depending on the pilot pressure applied to the hydraulic driving sector 51a of the flow control valve 5b.

As the arm is gradually moved toward the body and the bucket tip comes closer to the boundary L of the set area as mentioned above, the bucket tip speed limit value a calculated by the calculating portion 9C is increased (the absolute value |a| is reduced). Then, when the limit value a becomes greater than the component by of the arm-dependent bucket tip speed b vertical to the boundary L calculated by the calculating portion 9E, the limit value $c=a-b_y$ of the boom-dependent bucket tip speed is calculated as a positive value by the calculating portion 9F, and the valve command calculating portion 9I outputs a voltage corresponding to the limit value c to the proportional solenoid valve 10*a* on the boom-up side, thereby restricting the pilot pressure for the hydraulic driving sector 50*a* of the flow control valve 5*a* to the limit value, and also outputs a nil (0) voltage to the proportional solenoid valve 10*b* on the boom-down side for making nil the pilot pressure for the hydraulic driving sector 50*b* of the flow control valve 5*a*. Therefore, the boom-up operation for modifying the bucket tip speed is performed such that the component of the bucket tip speed vertical to the boundary L is gradually restricted in proportion to the distance D from the bucket tip to the boundary L. Thus, slowdown direction change control is carried out with a resultant of the unmodified component $b_x$ of the arm-dependent bucket tip speed parallel to the boundary L and the speed component vertical to the boundary L modified depending on the limit value c, in the same manner as shown in FIG. 12, enabling the excavation to be performed along the boundary L of the set area.

Further, when the bucket tip has moved out beyond the boundary L of the set area, the limit value a of the bucket tip speed in proportion to the distance D from the bucket tip to the boundary L of the set area is calculated as a positive value by the calculating portion 9C based on the relationship shown in FIG. 28, the limit value $c=a-b_y$ (>0) of the boom-dependent bucket tip speed calculated by the calculating portion 9F is increased in proportion to the limit value a, and the voltage output from the valve command calculating portion 9I to the proportional solenoid valve 10*a* on the boom-up side is increased depending on the limit value c. In the case of the bucket tip going out of the set area, therefore, the boom-up operation for modifying the bucket tip speed is performed so that the bucket tip is restored to the set area at a speed proportional to the distance D. Thus, the excavation is carried out under a combination of the unmodified component $b_x$ of the arm-dependent bucket tip speed parallel to the boundary L and the speed component vertical to the boundary L modified depending on the limit value c, while the bucket tip is gradually returned to and moved along the boundary L of the set area, in the same manner as shown in FIG. 14. Consequently, the excavation can be smoothly performed along the boundary L of the set area just by crowding the arm.

Moreover, in the above arm crowding operation, the pilot pressure representing the command value from the arm control lever unit 4*b* is detected by the pressure sensor 61*a*, and a detection signal of the pressure sensor 61*a* is applied to the lever signal slowdown control calculating portion 9M which calculates a target pilot pressure for the lever signal slowdown control. In this respect, when the bucket tip is so far away from the boundary L of the set area as to meet the relationship of $D \geqq Ya1$, or when the mode switch 20 is turned off, the lever signal slowdown control switching portion 9S outputs, as the limit value of the arm pilot pressure, a maximum value rather than the target pilot pressure calculated by the calculating portion 9M, and the valve command calculating portion 9K outputs a corresponding voltage to the proportional solenoid valve 11*a*on the arm-crowding side to maximize an opening of the proportional solenoid valve 11*a*. Therefore, the pilot pressure input from the control lever unit 4*b* is applied, as it is, to the hydraulic driving sector 51*b* of the flow control valve 5*b* on the arm-crowding side. As a result, the arm is moved down toward the body as per manipulation of the control lever unit 4*b* by the operator.

When not only the bucket tip comes so close to the boundary L of the set area as to meet the relationship of $D<Ya1$ with the arm moved toward the body, but also the mode switch 20 is turned on, the lever signal slowdown control switching portion 9S outputs, as the limit value of the arm pilot pressure, the target pilot pressure for the lever signal slowdown control calculated by the calculating portion 9M, and the valve command calculating portion 9K outputs a voltage corresponding to the limit value to the proportional solenoid valve 11*a* on the arm-crowding side, thereby restricting the pilot pressure for the hydraulic driving sector 51*a* of the flow control valve 5*b* to the limit value. Consequently, the arm is slowed down as the bucket tip comes closer to the boundary L of the set area.

As is apparent from the above description, this embodiment can also provide similar advantages as in the first and second embodiments.

In the foregoing embodiments, the low-pass filter process using the time constant tg and the slowdown process multiplying the operation signal by the slowdown coefficient hg are both performed in the lever signal slowdown control. However, it is also possible to perform only the slowdown process multiplying the operation signal by the slowdown coefficient hg.

Also, in the foregoing embodiments, the bucket tip is selected as a predetermined part of the front device. From the viewpoint of implementing the invention in a simpler way, however, a pin at the arm tip may be selected as a predetermined part of the front device. Further, when an area is set for the purpose of preventing interference of the front device and ensuring safety, a predetermined part of the front device may be any other part taking part in such an interference.

While the hydraulic drive system to which the present invention is applied has been described as a closed center system including the flow control valves 15*a*–15*f* of closed center type, the invention is also applicable to an open center system including flow control valves of open center type.

The relationships of the distance between the bucket tip and the boundary of the set area with respect to the slowdown vector, the time constant tg, the slowdown coefficient hg, and the restoration vector are not limited to the relationships set in the foregoing embodiments, but may be set in various ways.

The foregoing embodiments are arranged such that when the bucket tip is away from the boundary of the set area, the target speed vector is output as it is. Even in such a condition, however, the target speed vector may also be modified for any other purpose.

While the vector component of the target speed vector in the direction toward the boundary of the set area has been described as being vertical to the boundary of the set area, it may be deviated from the vertical direction so long as the bucket tip can be moved in the direction along the boundary of the set area.

In the above second embodiment, etc. wherein the present invention is applied to a hydraulic excavator having control lever units of the hydraulic pilot type, the proportional solenoid valves 10*a*, 10*b*, 11*a*, 11*b* are employed as the electro-hydraulic converting means and the pressure reducing means. But the proportional solenoid valves may be replaced by any other suitable electro-hydraulic converting means.

Further, while the control lever units 14*a*–14*f* and the flow control valves 15*a*–15*f* have all been described as being of hydraulic pilot type, it is only required that at least the control lever units 14*a*, 14*b* and the flow control valves 15*a*, 15*b* for the boom and the arm are of the hydraulic pilot type.

INDUSTRIAL APPLICABILITY

According to the present invention, since movement of the front device toward the boundary of the set area is slowed down when the front device comes close to the set area, excavation within a limited area can be performed efficiently.

Also, since the operation signal of the operating means is itself reduced, excavation within a limited area can be smoothly performed even when the operating means is abruptly manipulated.

Further, when performing excavation within a limited area, the operator can select one of the accuracy precedence work mode and the speed precedence work mode at his own discretion.

We claim:

1. An area limiting excavation control system for construction machines comprising a plurality of driven members (1*a*–1*e*) including a plurality of front members (1*a*–1*c*) which make up a multi-articulated front device (1A) and are pivotable in the vertical direction, a plurality of hydraulic actuators (3*a*–3*f*) for driving respectively said plurality of driven members, a plurality of operating means (14*a*–14*f*; 4*a*–4*f*) for instructing operation of said plurality of driven members, and a plurality of hydraulic control valves (15*a*–15*f*; 5*a*–5*f*) driven in accordance with operation signals from said plurality of operating means for controlling flow rates of a hydraulic fluid supplied to said plurality of hydraulic actuators, wherein said control system further comprises:

area setting means (7; 7, 9*a*) for setting an area where said front device (1A) is movable;

first detecting means (8*a*–8*d*) for detecting status variables in relation to a position and posture of said front device (1A);

first calculating means (250; 9*b*) for calculating the position and posture of said front device (1A) based on signals from said first detecting means;

first signal modifying means (260; 9*m*, 11*a*, 11*b*; 9M, 11*a*, 11*b*) for modifying, based on values calculated by said first calculating means, at least the operation signal from the operating means (14*b*, 4*b*) associated with a first particular front member (1*b*) among said plurality of operating means (14*a*–14*f*; 4*a*–4*f*) so as to reduce said operation signal, when said front device (1A) is near the boundary of the set area therewithin; and second signal modifying means (270, 280; 9*c*–9*f*, 10*a*, 10*b*, 12; 9D–9I, 10*a*, 10*b*, 12) for calculating, based on at least the operation signal reduced by said first signal modifying means and the values calculated by said first calculating means, a speed (Vc; b) for control of said front device (1A), and modifying, based on said speed for control, at least the operation signal from the operating means (14*a*; 4*a*) associated with a second particular front member (1*a*) among said plurality of operating means, such that a moving speed (Vcy; $b_y$) of said front device in the direction toward the boundary of the set area is reduced within the set area.

2. An area limiting excavation control system for construction machines according to claim 1, further comprising:

mode selecting means (20, 257; 20, 9*m*, 152; 20, 9S) for selecting whether or not the operation signal from the operating means is modified to be reduced by said first signal modifying means, wherein when said mode selecting means is operated to select no modification by said first signal modifying means (260; 9*m*, 11*a*, 11*b*; 9M, 11*a*, 11*b*), said first signal modifying means does not modify the operation signal and said second signal modifying means (270, 280; 9*c*–9*f*, 10*a*, 10*b*, 12; 9D–9I, 10*a*, 10*b*, 12) calculates, based on at least the operation signal not modified and the values calculated by said first calculating means (250; 9*b*), the speed (Vc; b) for control of said front device (1A), and modifies, based on said speed for control, at least the operation signal of said operating means (14*a*; 4*a*) associated with said second particular front member (1*a*) among said plurality of operating means (14*a*–14*f*; 4*a*–4*f*), such that the moving speed (Vcy, $b_y$) in the direction toward the boundary of the set area is reduced.

3. An area limiting excavation control system for construction machines according to claim 1, wherein said first signal modifying means (260; 9*m*, 11*a*, 11*b*; 9M, 11*a*, 11*b*) includes means (261, 263; 160, 163, 164) for modifying the operation signal from said operating means (14*b*; 4*b*) associated with said first particular front member (1*b*) so as to reduce the operation signal, such that the operation signal is reduced in a larger amount as a distance between said front device (1A) and the boundary of the set area decreases, and the operation signal does not become nil on the boundary of the set area.

4. An area limiting excavation control system for construction machines according to claim 3, wherein said first signal modifying means (260; 9*m*, 11*a*, 11*b*; 9M, 11*a*, 11*b*) further includes means (261, 263; 160, 163, 164) for modifying the operation signal from said operating means (14*b*; 4*b*) associated with said first particular front member such that the operation signal is reduced in a larger amount as an angle (θg) formed between said first particular front member (1*b*) and the boundary of the set area decreases.

5. An area limiting excavation control system for construction machines according to claim 3, wherein said first signal modifying means (260; 9*m*, 11*a*, 11*b*; 9M, 11*a*, 11*b*) further includes means (261, 262; 160, 161, 164) for modifying the operation signal from said operating means (14*b*; 4*b*) associated with said first particular front member (1*b*) so as to reduce the operation signal by performing a low-pass filter process on the operation signal.

6. An area limiting excavation control system for construction machines according to claim 1, in which at least said operating means (4*b*, 4*a*) associated with said first and second particular front members (1*b*, 1*a*) among said plurality of operating means (4*a*–4*f*) are of the hydraulic pilot type which outputs pilot pressures as the operation signals, and an operating system including said operating means (4*b*, 4*a*) of the hydraulic pilot type drives the corresponding hydraulic control valves (5*b*, 5*a*), wherein said control system further includes second detecting means (61, 61*b*) for detecting an input amount of said operating means (4*b*) associated with said first particular front member (1*b*), and said first signal modifying means (260; 9*m*, 11*a*, 11*b*; 9M, 11*a*, 11*b*) includes second calculating means (160–165) inputting a signal from said second detecting means (61*a*, 61*b*) and the values calculated by said first calculating means for calculating a pilot pressure limit value based on the signal from said second detecting means (61*a*, 61*b*) when said front device (1A) is near the boundary of the set area therewithin, and first pilot pressure control means (166, 11*a*, 11*b*; 9K, 11*a*, 11*b*) for controlling the pilot pressure delivered from the corresponding operating means (4*b*) such that a pilot pressure applied to said hydraulic control valve (5*b*) is not more than said limit value.

7. An area limiting excavation control system for construction machines according to claim 6, said operating system includes first pilot lines (45*a*, 45*b*) for introducing the pilot pressures to the hydraulic control valve (5*b*) associated with the first particular front member (1*b*), and said first pilot pressure control means includes means (166; 9K) for outputting an electric signal corresponding to the pilot pressure limit value, and first electro-hydraulic converting means (11*a*, 11*b*) disposed in said first pilot lines (45*a*, 45*b*) and driven by said electric signal.

8. An area limiting excavation control system for construction machines according to claim 6, wherein said control system further comprises third detecting means (61*c*, 61*d*) for detecting the pilot pressure controlled by said first pilot pressure control means (166, 11*a*, 11*b*; 9K, 11*a*, 11*b*), and said second signal modifying means (9*c*–9*f*, 10*a*, 10*b*, 12; 9D–9I, 10*a*, 10*b*, 12) includes third calculating means (9*j*; 9H) for calculating, based on a signal from said third detecting means (61*c*, 61*d*), a pilot pressure applied to said hydraulic control valve (5*a*) associated with said second particular front member (1*a*), and second pilot pressure control means (9*k*, 10*a*, 10*b*, 12; 9I, 10*a*, 10*b*, 12) for controlling the pilot pressure delivered from the corresponding operating means (4*a*) such that the pilot pressure calculated by said third calculating means is produced.

9. An area limiting excavation control system for construction machines according to claim 8, wherein said operating system includes second pilot lines (44*a*, 44*b*) for introducing the pilot pressures to the hydraulic control valve (5*a*) associated with the second particular front member (1*a*), and said second pilot pressure control means includes means (9*k*; 9I) for outputting an electric signal corresponding to the pilot pressure calculated by said third calculating means (9*j*; 9H), second electro-hydraulic converting means (10*a*, 10*b*) driven by said electric signal for delivering said pilot pressure, and means (12) disposed in said second pilot line (44*a*) for selecting higher one of the pilot pressure delivered from said operating means (4*a*) associated with said second particular front member (1*a*) and the pilot pressure delivered from said second electrohydraulic converting means (10*a*).

10. An area limiting excavation control system for construction machines according to claim 1, wherein said first particular front member includes at least an arm (1*b*) of a hydraulic excavator, and said second particular front member includes at least a boom (1*a*) of the hydraulic excavator.

* * * * *

UNITED STATES PATENT AND TRADEMARK OFFICE

CERTIFICATE OF CORRECTION

PATENT NO. : 5,752,333

DATED : May 19, 1998

INVENTOR(S) : T. NAKAGAWA et al

It is certified that error appears in the above-indentified patent and that said Letters Patent is hereby corrected as shown below:

Column 1, line 15, delete the line in its entirety and insert --A hydraulic excavator is a typical known type of--;
line 16, change "machines" to --machine--; and
line 54, delete "DISCLOSURE OF THE INVENTION".

Column 2, between lines 15 and 16, insert --SUMMARY OF THE INVENTION--.

Column 4, line 51, change "los-pass" to --low-pass--.

Column 7, line 46, change "FIG. 2" to --Figs. 1, 2 and 3--.

Column 11, line 53, change "determinant" to --determined--.

Column 17, line 15, after "driving" insert --a--.

IN THE CLAIMS

Column 35, claim 1, line 15, delete "(1a-1e)" and "(1a-1c)";
line 16, delete "(1A)";
line 18, delete "(3a-3f)";
line 19, delete "(14a-14f)";
line 20, delete "(4a-4f)";
line 22, delete "(15a-15f; 5a-5f)";
line 27, delete "(7; 7, 9a)";
line 28, delete "(1A)";
line 29, delete "(8a-8d)";
line 31, delete "(1A)";
line 32, delete "(250; 9b)";
line 33, delete "(1A)";
line 35, delete "(260; 9m, 11a, 11b; 9M, 11a,";

UNITED STATES PATENT AND TRADEMARK OFFICE

CERTIFICATE OF CORRECTION

PATENT NO. : 5,752,333

DATED : May 19, 1998

INVENTOR(S) : T. NAKAGAWA et al

It is certified that error appears in the above-indentified patent and that said Letters Patent is hereby corrected as shown below:

Column 35, claim 1 continued:
line 36, delete "11b)";
line 38, delete "(14b, 4b)";
line 39, delete "(1b)";
line 40, delete "(14a-14f; 4a-4f)";
line 41, delete "(1A)";
line 43, delete "(270, 280; 9c-9f, 10a,";
line 44, delete "10b, 12; 9D-9I, 10a, 10b, 12)";
line 48, delete "(Vc; b)";
line 49, delete "(1A)";
line 51, delete "(14a; 4a)";
line 52, delete "(1a)"; and
line 53, delete "(Vcy; $b_y$)".

Column 35, claim 2, line 58, delete "(20, 257; 20, 9m, 152; 20, 9S)";
line 64, delete "(260; 9m, 11a, 11b; 9M, 11a, 11b)";
line 66, delete "(270,";
line 67, delete "280; 9c-9f, 10a, 10b, 12; 9D-9I, 10a, 10b, 12)";

Column 36, line 3, delete "(250;9b)" and "(Vc; b)";
line 4, delete "(1A)";
line 6, delete "(14a; 4a)";
line 7, delete "(1a)";
line 8, delete "(14a-14f; 4a-4f)"; and
line 9, delete "(Vcy, $b_y$)".

Column 36, claim 3, line 13, delete "(260; 9m, 11a, 11b; 9M, 11a, 11b)";
line 14, delete "(261, 263; 160, 163, 164)";
line 15, delete "(14b; 4b)";
line 16, dlete "(1b)"; and
line 19, delete "(1A)".

UNITED STATES PATENT AND TRADEMARK OFFICE

CERTIFICATE OF CORRECTION

PATENT NO. : 5,752,333

DATED : May 19, 1998

INVENTOR(S) : T. NAKAGAWA et al

It is certified that error appears in the above-indentified patent and that said Letters Patent is hereby corrected as shown below:

Column 36, claim 4, line 24, delete "(260; 9m, 11a, 11b; 9M, 11a, 11b)";
line 25, delete "(261, 263; 160, 163, 164)";
line 26, delete "(14b;";
line 27, delete "4b)"; and
line 30, delete "(1b)".

Column 36, claim 5, line 33, delete "(260; 9m, 11a, 11b; 9M, 11a, 11b)";
line 34, delete "(261, 262; 160, 161, 164)";
line 35, delete "(14b;"; and
line 36, delete "4b)" and "(1b)".

Column 36, claim 6, line 41, delete "(4b, 4a)";
line 42, delete "(1b, 1a)";
line 43, delete "(4a-4f)";
line 45, delete "(4b,";
line 46, delete "4a)";
line 47, delete "(5b, 5a)";
line 49, delete "(61, 61b)";
line 50, delete "(4b)";
line 51, delete "(1b)";
line 52, delete "(260; 9m, 11a, 11b; 9M,";
line 53, delete "11a, 11b)" and "(160-165)";
line 55, delete "(61a, 61b)";
line 58, delete "(61a, 61b)" and "(1A)";
line 60, delete "(166, 11a, 11b; 9K, 11a, 11b)";
line 62, delete "(4b)"; and
line 63, delete "(5b)".

Column 36, claim 7, line 67, delete "(45a, 45b)";
Column 37, line 1, delete "(5b)";
line 2, delete "(1b)";
line 3, delete "(166;";

UNITED STATES PATENT AND TRADEMARK OFFICE

CERTIFICATE OF CORRECTION

PATENT NO. : 5,752,333
DATED : May 19, 1998
INVENTOR(S) : T. Nakagawa, et al

It is certified that error appears in the above-identified patent and that said Letters Patent is hereby corrected as shown below:

Column 37, claim 7 continued:
line 4, delete "9K)";
line 6, delete "(11a, 11b)"; and
line 7, delete "(45a, 45b)".

Column 37, claim 8, line 10, delete "(61c,";
line 11, delete "61d)";
line 12, delete "(166, 11a, 11b; 9K, 11a, 11b)";
line 13, delete "(9c-9f, 10a, 10b,";
line 14, delete "12; 9D-9I, 10a, 10b, 12)";
line 15, delete "(9j; 9H)";
line 16, delete "(61c, 61d)";
line 17, delete "(5a)";
line 18, delete "(1a)";
line 19, delete "(9K, 10a, 10b, 12; 9I, 10a, 10b, 12)"; and
line 21, delete "(4a)".

UNITED STATES PATENT AND TRADEMARK OFFICE

CERTIFICATE OF CORRECTION

PATENT NO. : 5,752,333

DATED : May 19, 1998

INVENTOR(S) : T. NAKAGAWA et al

It is certified that error appears in the above-identified patent and that said Letters Patent is hereby corrected as shown below:

Column 38, claim 9, line 3, delete "(44a, 44b)";
line 5, delete "(5a)";
line 6, delete "(1a)";
line 7, delete "(9K; 9I)";
line 9, delete "(9j, 9H)";
line 10, delete "(10a, 10b)";
line 11, delete "(12)";
line 12, delete "(44a)";
line 13, delete "(4a)";
line 14, delete "(1a)"; and
line 16, delete "(10a)".

Column 38, claim 10, line 18, delete "(1b)"; and
line 20, delete "(1a)".

Signed and Sealed this

Thirteenth Day of October 1998

*Attest:*

Bruce Lehman

BRUCE LEHMAN

*Attesting Officer*

*Commissioner of Patents and Trademarks*